US010278483B2

(12) United States Patent
Moore

(10) Patent No.: US 10,278,483 B2
(45) Date of Patent: May 7, 2019

(54) CARRYING DEVICE AND SYSTEM THEREROF

(71) Applicant: Bag A Bucket Australia Pty Ltd, Padstow (AU)

(72) Inventor: Kristan Moore, Padstow (AU)

(73) Assignee: Bag A Bucket Australia Pty Ltd, Padstow (AU)

( * ) Notice: Subject to any disclaimer, the term of this patent is extended or adjusted under 35 U.S.C. 154(b) by 0 days.

(21) Appl. No.: 15/912,001

(22) Filed: Mar. 5, 2018

(65) Prior Publication Data

US 2018/0255913 A1 Sep. 13, 2018

(30) Foreign Application Priority Data

Mar. 13, 2017 (AU) ..... 2017900872
Jul. 14, 2017 (AU) ..... 2017902768
Sep. 21, 2017 (AU) ..... 2017903840
Nov. 10, 2017 (AU) ..... 2017904575

(51) Int. Cl.
*A45F 5/10* (2006.01)
*A45F 3/02* (2006.01)

(52) U.S. Cl.
CPC ..... *A45F 5/102* (2013.01); *A45F 3/02* (2013.01); *A45F 5/1026* (2013.01); *A45F 2005/1013* (2013.01); *A45F 2005/1033* (2013.01); *A45F 2005/1073* (2013.01)

(58) Field of Classification Search
CPC ..... A45F 5/102; A45F 5/1026; A45F 5/1046; A45F 2005/1033; A45F 2005/104; A45F 2005/1053; A45F 2005/106; A45F 2005/1066; A45F 2005/1073; A45F 3/02; A45F 2005/1013
USPC ..... 294/165, 33, 170; 16/425
See application file for complete search history.

(56) References Cited

U.S. PATENT DOCUMENTS 399,180 A * 3/1889 Bridwell
1,572,006 A * 2/1926 Griffin ..... A45F 5/1026 16/406
3,306,507 A * 2/1967 Wilson ..... A45F 5/10 16/406
3,679,103 A * 7/1972 Chmela ..... A45F 5/10 222/173
5,181,757 A * 1/1993 Montoya ..... A45F 5/1026 294/159
5,487,581 A 1/1996 Carmo et al.
5,507,544 A * 4/1996 McQuade ..... A45F 5/10 220/759

(Continued)

FOREIGN PATENT DOCUMENTS

BE 1004331 * 11/1992
FR 2541099 A1 * 8/1984 ..... A45F 5/1026

*Primary Examiner* — Dean J Kramer
(74) *Attorney, Agent, or Firm* — Kaplan Breyer Schwarz, LLP

(57) ABSTRACT

A device for carrying a flexible tub having a first hoop handle and a second hoop handle, the device comprising an elongate member further comprising an upper surface, a lower surface, a first end, and an opposed second end. The first end comprises a first handle connector, and wherein the second end comprises a second handle connector. The first handle connector is adapted to receive the first hoop handle, when in use, and the second handle connector is adapted to receive the second hoop handle, when in use.

20 Claims, 18 Drawing Sheets

(56) References Cited

U.S. PATENT DOCUMENTS

| | | | | |
|---|---|---|---|---|
| 5,667,266 | A | 9/1997 | Giocanti | |
| 6,499,781 | B1 * | 12/2002 | Flynn | A45F 3/10 294/159 |
| 7,681,766 | B2 * | 3/2010 | Harrison, III | A45F 3/10 224/265 |
| 2006/0022476 | A1 * | 2/2006 | Caputi | A45C 13/30 294/153 |

* cited by examiner (a)

(b)

(c)

(d)

(a)

(b)

CARRYING DEVICE AND SYSTEM THEREROF

RELATED APPLICATIONS

This application claims the priority benefits of Australian Application No. 2017904575, filed Nov. 10, 2017, Australian Application No. 2017903840, filed Sep. 21. 2017, Australian Application No. 2017002768, filed Jul. 14, 2017, and Australian Application No. 2017900872 filed Mar. 13, 2017, the entire disclosures of which are incorporated herein by reference.

TECHNICAL FIELD

The present invention relates to a carry device, handle, system for use with a flexible tub. More particularly, the preset invention relates to a device for carrying a tub, bucket or receptacle. More particularly, the present disclosure may relate to a device for carrying a flexible tub with a first loop handle and a second loop handle.

BACKGROUND

Carry poles and yokes are well recognised and typically used to assist a user to manually transport loads. Generally, a yoke is used by people in one of two ways: a single person who balances the yoke over one or two shoulders, with two separate loads being suspended from respective opposed ends of the yoke; or two people who support the yoke from each end of the yoke, with the load suspended from the centre of the yoke. Similarly, animals may balance the yoke to enable them to pull together on a load when working in pairs. A yoke typically is a tapered beam made of wood or bamboo, and the load attached to the ends of the yoke may be hung directly from the yoke, without the use of rope. The attachment of the load to the ends of the yoke may also be tied by rope.

Yokes also typically shaped or has carved-out sections to suit the shape of the user's shoulders. An example of which is an oxbow, in which the oxbow is usually U-shaped to adaptably be held on the animal's necks.

Another device such as a bindle or a blanket stick is also used by a single person to assist a user to carry at least one load, in which the at least one load is all at an end of the bindle. The person carries the stick at the other end of the bindle and with the entire array being supported and carried over a shoulder. In reference to bindles, the load is mounted only at end of stick and the system acts as a cantilever across the shoulder of the user. The load is balanced by the pressure on the stick applied across the users shoulder acting as a fulcrum.

For example, U.S. Pat. No. 5,487,581 describes a hand grip for carrying bags that contains a single hook for holding the bags. A disadvantage with this previous device may be the device not able to provide proper weight distribution in the case of carrying loads.

U.S. Pat. No. 5,667,266 describes a type of grip also for carrying bags with loop handles with hooks for carrying the bags, and that it is capable of being carried by hand or on a shoulder. A disadvantage with this previous device may be that the hooks may have insufficient support at the ends of the device. Additionally, this design only works with two light weight plastic shopping bags and only works wherein two shopping bags are used at either end of the device. Also, both shopping bags need to be equalled weighted to prevent device failure or user injury.

Other designs have been developed in the past to overcome the disadvantages mentioned above, however, current devices for carrying items and/or loads may include some disadvantages relating to not distributing weight well on one end of the device compared to another end of the device during the use of the device. In light of the aforementioned disadvantages, there exists a long-felt need to provide a device that may overcome one or more shortcomings of carry devices as described in the prior art.

Any discussion of the prior art throughout the specification should in no way b considered as an admission that such prior art is widely known or forms part of common general knowledge in the field.

SUMMARY

Problems to be Solved

It may be advantageous to provide a device for carrying a tub with two handles.

It may be an advantage to provide a device which allows a user to lift a tub by the handles without the user holding onto the handles of the tub.

It may be an advantage to provide a device which is resiliently biased.

It may be an advantage to provide a device with securing means to retain the hoop handles of the tub.

It may be an advantage to provide a device with strap attachment means to allow a user the option to carry the device over the user's shoulder.

It may be an advantage to provide a device with strap attachment means that have curved slots to reduce stress and/or strain concentration to the device.

It is an object of the present invention to overcome or ameliorate at least one of the disadvantages of the prior art, or to provide a useful alternative.

Means for Solving the Problem

A first aspect of the present invention may relate to a device adapted for carrying a flexible tub with a first hoop handle and a second hoop handle, the device may comprise an elongate member which may further comprise an upper surface, a lower surface, a first end and a second end. The first end may comprise a first securing means, and the second end may comprise a second securing means. The first securing means may be adapted to receive the first hoop handle, when in use, and the second securing means may be adapted to receive the second hoop handle, when in use.

Preferably, the first security means may be positioned on the upper surface.

Preferably, the second securing means may be positioned on the upper surface.

Preferably, the elongate member may be adapted to bend and be resiliently biased to absorb load of the flexible tub.

Preferably, the first securing means may be a first cavity.

Preferably, the second securing means may be a second cavity.

Preferably, the first or second cavity may have an elliptical profile wherein the apex may be positioned towards the middle of the elongate member.

Preferably, the first securing means may have a first boss positioned at the first cavity opening.

Preferably, the second securing means may have a second boss positioned at the second cavity opening.

Preferably the first boss may be a first rounded face.

Preferably, the second boss may be a second rounded face.

Preferably, the first cavity may have a first rounded profile.

Preferably, the second cavity may have a second rounded profile.

Preferably, the first security means may have a first boss positioned at the first cavity opening.

Preferably, the second securing means way have a second boss positioned at the second cavity opening.

Preferably, the first boss may have a first rounded face.

Preferably, the second boss may have a second rounded face.

Preferably, the first cavity opening may be directed away from the second cavity opening.

Preferably, the first end may comprise a first strap attachment means.

Preferably, the second end may comprise a second strap attachment means.

Preferably, the first strap attachment means and the second strap attachment means may be each selected from at least one of: a support loop positioned at the upper surface, and a slot positioned between the upper surface and the lower surface.

Preferably, the profile of the first end may be symmetrical relative to the profile of the second end.

Preferably, the length of the elongate member may be greater than the resting diameter of the flexible tub; and the length of the elongate member may be less than the maximum diameter of the flexible tub, wherein the first and second hoop handles are moved apart.

Preferably, the device may be adapted to engage a maximum of only one flexible tub at any period of time.

Preferably, the material of the device may be constructed of one material selected from the following group: polypropylene, glass fibre reinforced polypropylene, poly(hexano-6-lactam), glass fibre reinforced poly(hexano-6-lactam), acrylonitrile butadiene styrene, a blend of polycarbonate and acrylonitrile butadiene styrene, glass reinforced blend of polycarbonate and acrylonitrile butadiene styrene, and high-density polyethylene.

Preferably, the glass fibre may be present in a range between 20 to 50 weight percentage in the glass fibre reinforced polypropylene, glass fibre reinforced poly (hexano-6-lactam) or glass fibre reinforced blend of polycarbonate and acrylonitrile butadiene styrene.

Preferably, the device may be formed from by injection moulding.

Preferably, the elongate member may have a curved profile.

Preferably, the elongate member may have a partially sinusoidal profile.

Preferably, the device may have at least two structural reinforcement means proximal to the respective first and second ends.

Preferably, the device may include flexible and circular restraining strap to engage and restrain the first hoop handle and the first securing means.

In the context of the present invention, the words "comprised", "comprising" and the like are to be construed in their inclusive, as opposed to their exclusive, sense, that is in the sense of "including, but not limited to".

The invention is to be interpreted with reference to the at least one of the technical problems described or affiliated with the background art. The present aims to solve or ameliorate at least one of the technical problems and this may result in one or more advantageous effects as defined by this specification and described in detail with reference to the preferred embodiments of the present invention.

BRIEF DESCRIPTION OF THE FIGURES

Notwithstanding any other forms which may fall within the scope of the present invention, preferred embodiments of the present invention will now be described, by way of examples only, with reference to the accompanying drawings in which:

FIG. 9(*b*) depicts a cross sectional view of a handle grip of the further preferred embodiment.

FIG. 13(*b*) depicts a side view of a first or second end of another further preferred embodiment.

DESCRIPTION OF THE INVENTION

Figure 1:
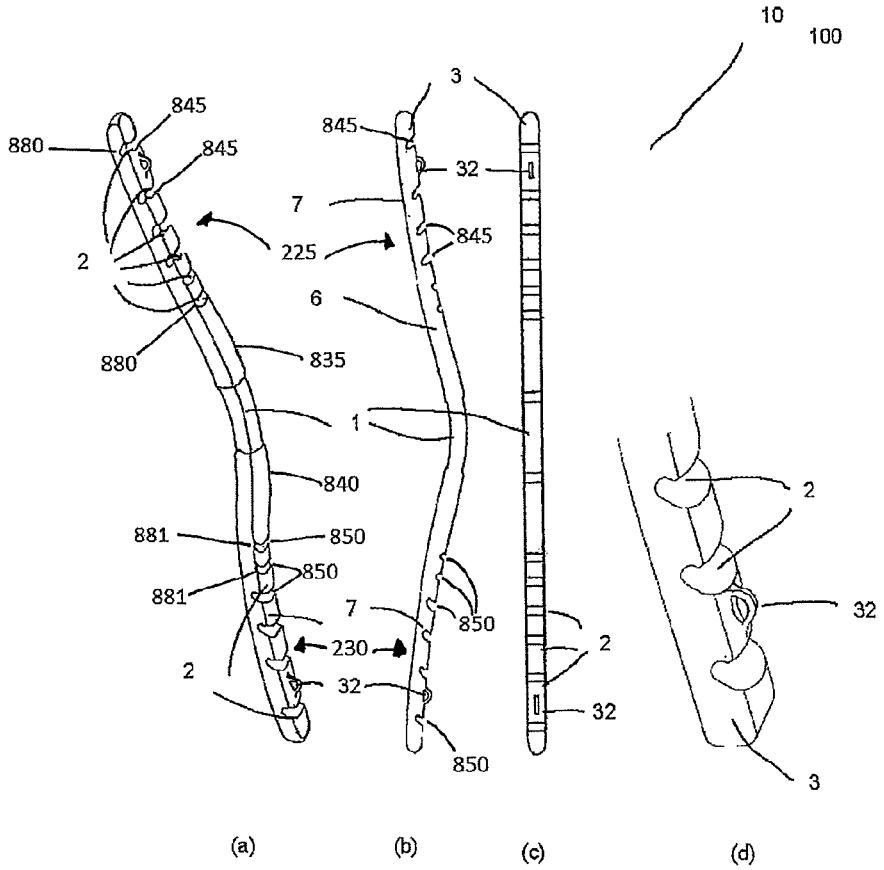
FIG. 1 depicts (*a*) a perspective view, (*b*) a side view, (*c*) a top view, and (*d*) an enlarged end view of a carry handle for a flexible tub in accordance with a first preferred embodiment of the present invention.

Preferred embodiments of the invention will now be described with reference to the accompanying drawings and non-limiting examples. It should be noted in the following description that like or the same reference numerals in different embodiments denote the same or similar features.

In an embodiment of the present invention, as illustrated in FIGS. 1 to 7, FIG. 1 shows a carry handle 10 according to a preferred embodiment of the present invention. The carry handle 10 comprises a generally elongated rigid body 6 having a central grip portion 1 and opposite ends 3. The carry handle 10 further comprises two carry loop engagement sections 7 extending from opposite ends of the grip portion 1.

In the example, the body 6 curves upwardly such that the grip portion 1 will be disposed in use higher than the ends 3. The grip portion 1 is shaped for gripping by a user's hand. The engagement sections 7 each comprise a number of spaced notches 2 formed along a top surface of the body 6, with each notch 2 being shaped to receive and retain therein one of the carry loops 120 of a flexible tub 100. The outermost notches are shaped to be angled generally towards the grip portion 1. The innermost notches can also be angled, or can be generally vertical.

The notches 2 are formed identically relative to the grip portion 1. That is, each notch in one engagement section 7 has a corresponding paired notch at the other engagement section 7, with the paired notches being equally spaced from the grip portion 1.

Each engagement section 7 in the embodiment shown comprises six notches 2. The notches are spaced such that the paired notches 2 will engage different size flexible tubs having different distances between their respective carry loops. This carry handle 10 can further comprise a shoulder strap attachment means 32 formed between two notches 2, being a protrusion with an aperture.

Figure 2:
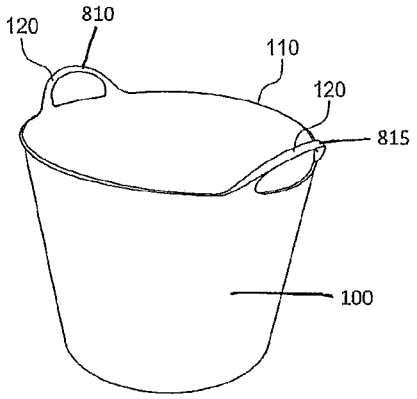
FIG. 2(*a*) shows a perspective view of a flexible tub, (*b*) shows a perspective view of a further preferred embodiment, and (*c*) and (*d*) are enlarged views of the preferred embodiment of FIG. 2(*b*)
Figure 2:
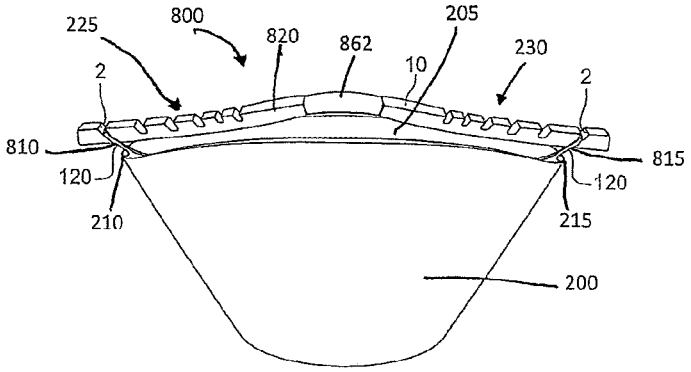
Figure 2:
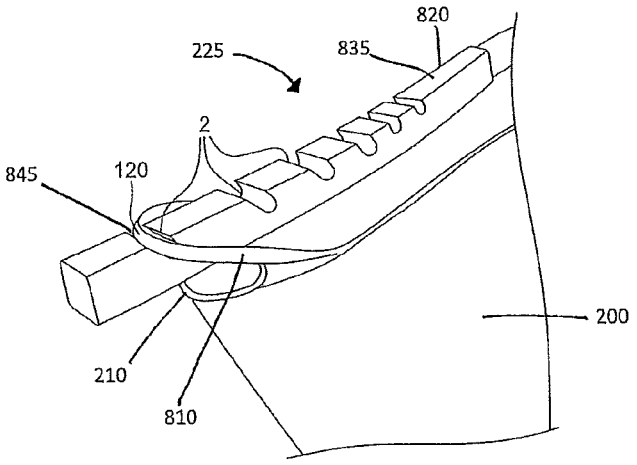
Figure 2:
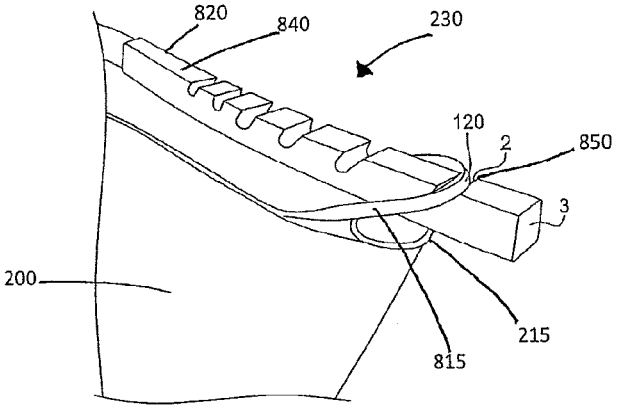

FIG. 2 shows the carry handle 10 in an example use with a flexible tub 100. One carry loop 120 is initially inserted into one of the notches 2 in one of the engagement section 7, being the outermost notch 2 in this example. The tub 100 is then stretched to insert the other carry loop 120 into a notch 2 at the other engagement section 7, being the opposite outermost notch 2. This shapes the tab 100 into a stretched configuration which closes the opening of the tub 100. The tub 100 can also be carried in a more open configuration by placing the carry loops 120 into notches closer to the grip portion 1.

The other carry loop 120 can however be received in a non-matching notch if desired. The notches 2 are angled inwardly towards the grip portion 1 which retains the carry loops 120 therein together with the resilience of the tub body 110, which prevents accidental removal of the carry loops 120 from the notches 2.

The installed carry handle 10 thus allows carrying of the tub 100 with one hand via the grip portion 1.

The carry handle 10 can increase or reduce the carrying loop spacing of a flexible tub 100 and hold those carrying loops 120 in place while spanning the distance between them. By spanning the distance between the two carrying loops 120, the carry handle 10 eliminates the need for two handed carrying and allows movement, travel or relocation of the tub 100 to be performed by one hand or multiple numbers of tubs are able to be moved at once by a single person.

The shape of or path the device takes between the carrying loops varies depending on the intended purpose of the flexible tub or tubs being used or moved. The device retains the adjusted loop positions to set distances by the use of notches located along the upper portion of the device. Notch position or distance from the centre of the device varies depending on the intended purpose of the flexible tub or tubs and the size of the tubs. Notch shape and form varies depending on the intended purpose of the flexible tub or tubs and may also incorporate a locking flap over the notch to retain the carrying loop in that notch.

Placement of a rigid component (carry handle 10) between the carrying loops 120 of the flexible tub 100 reduces flexibility by holding the carrying loops in a fixed position, giving greater control to the user by minimizing flexibility and unwanted movement.

The carry handle can be made from any desired rigid or substantially rigid material, such as timber, metal, rubber, plastic, leather or other composite or fabric. The carry handle in combination with flexible tubs can be used in various applications, such as the building and construction industry, trades such as carpentry, plumbing, electrical, painting, decorating, concreting, bricklaying, plastering, rendering, tilling, landscaping, the Manufacturing industry, inside and around the home, the garden, in schools, preschool, nurseries, and for many leisure activities e.g. at the beach, the pool, the gym and in various sports.

Examples of varying overall lengths with a single notch at each end to suit specific tub applications.

FIG. 2(*a*) shows a flexible tub 100 which comprises a flexible body 110 and two carrying loops 120 at a top edge thereof, at opposite portion of the body 110. The flexible nature of the multipurpose tub may allow more content to fit in the tub. Flexibility adds to the tub's appeal. The opening of the tub may change such that the opening becomes narrower. A narrower opening may prevent the contents from falling out of the tub when carried.

The tub may offer two carrying loops. Due to the flexibility of the material, these carrying loops can be manipulated to any position allowed by the tub's flexible range.

Figure 3:
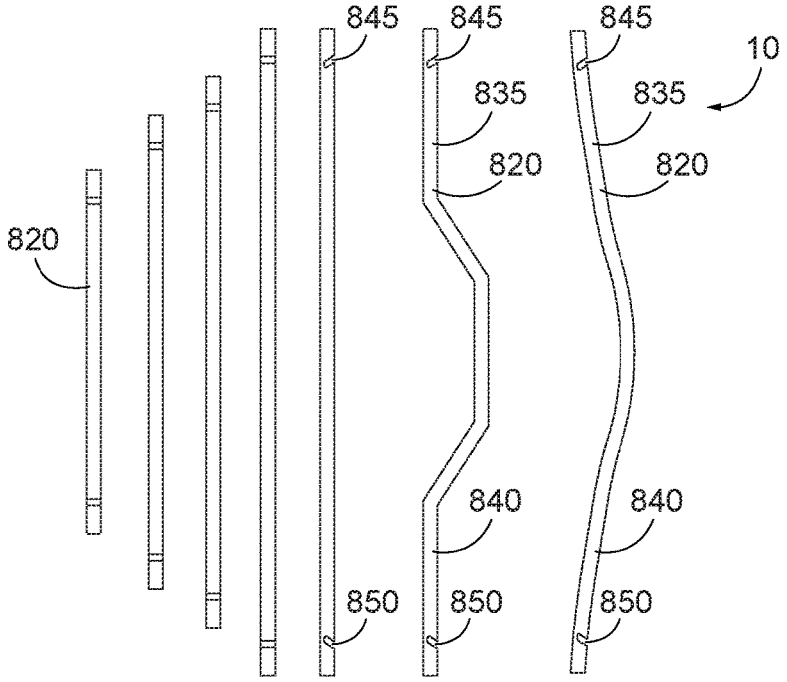
FIG. 3 depicts various side views of several preferred embodiment of the present invention.

FIG. 3 shows side views of possible modified lengths and shapes of the carry handle, the carry handle having a single notch at each end section thereof to receive a carry loop. Each carry handle in these examples is for a specific flexible tub size having a specified distance between its carry loops. As shown, the carry handle can have a straight body, a raised handle body or upwardly curved handle body.

Figure 4A:
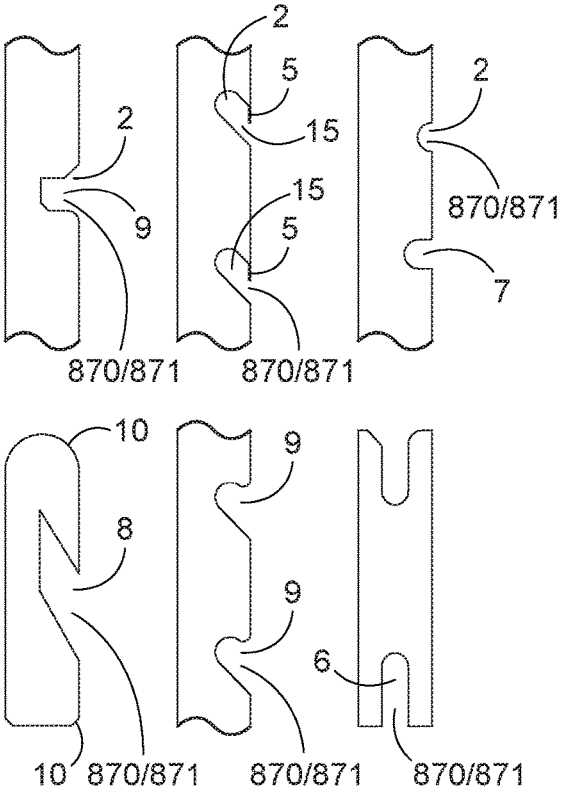
FIG. 4(*a*) depicts enlarged side views of various ends of several preferred embodiments, and (*b*) depicts cross-sectional views of shapes of the carrying handle of several preferred embodiments.
Figure 4B:
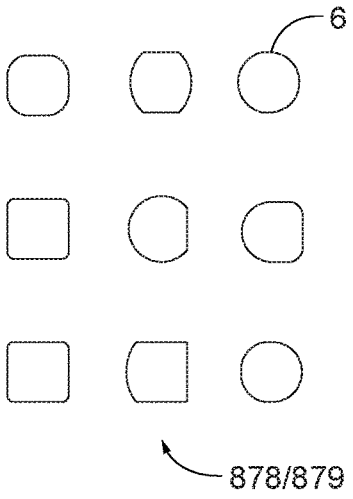

FIG. 4(*a*) shows side views of possible modified shapes of notches 2 of the carry handle. The notches 2 can be of different shapes, angles, and radii as required. Each notch can comprise a flexible locking flap 15 to allow the carrying loop to press past the flat 15 and into the notch, with the flap 15 then preventing the carrying loop from easy removal from the notch. The notches can be wider or larger in depth, and can also be formed at 0° (aligned with the length of the handle body 6) at the ends 3.

FIG. 4(*b*) shows cross-section views of possible modified shapes of cross-section shapes of the carry handle.

Figure 5:
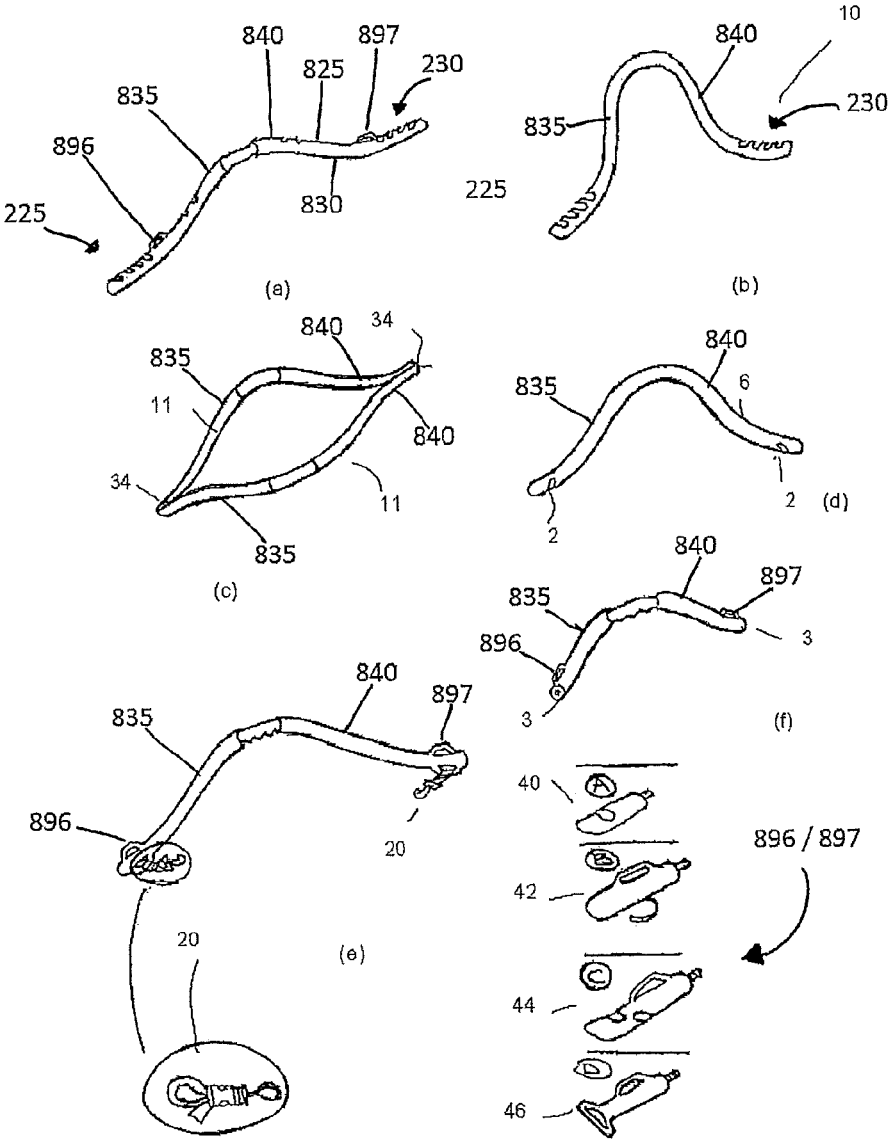
FIG. 5(*a*) to (*f*) depicts side views of various preferred embodiments.

FIG. 5(*a*) to (*f*) shows possible modified embodiment of the carry handle. FIG. 5(*a*) shows an example similar to the carry handle 10 having multiple notches to hold various sized tubs in both stretched and open configurations. FIG. 5(*b*) shows a higher curved handle, which can be used for carrying smaller tubs or for carrying over the user's shoulder.

FIG. 5(*c*) shows a two-piece handle version which are hinged 34 at the ends thereof. This version allows access to the tub whilst leaving the handle in place. The two handle pieces 11 can be moved to the sides to form a central opening in the handle. This version allows clear access to the tub's contents whilst leaving the handle in place, attached to the tub at both ends.

FIG. 5(*d*) shows a handle version with the carry loop notches 2 on the lower surface of the handle body 6.

FIG. 5(*e*) shows a handle version with fasteners 20 at the ends 3 thereof. The fastener 20 can be a snap hook, buckle or other type to fix to the carry loops.

FIG. 5(*f*) shows a handle version with female threaded ends 3, to which can be attached male threaded end sections having for example single slotted/notched ends 40, slip or loop type ends 42, flexible rubber with notched ends 44, or strap or fastex fitting slot ends 46.

Figure 6:
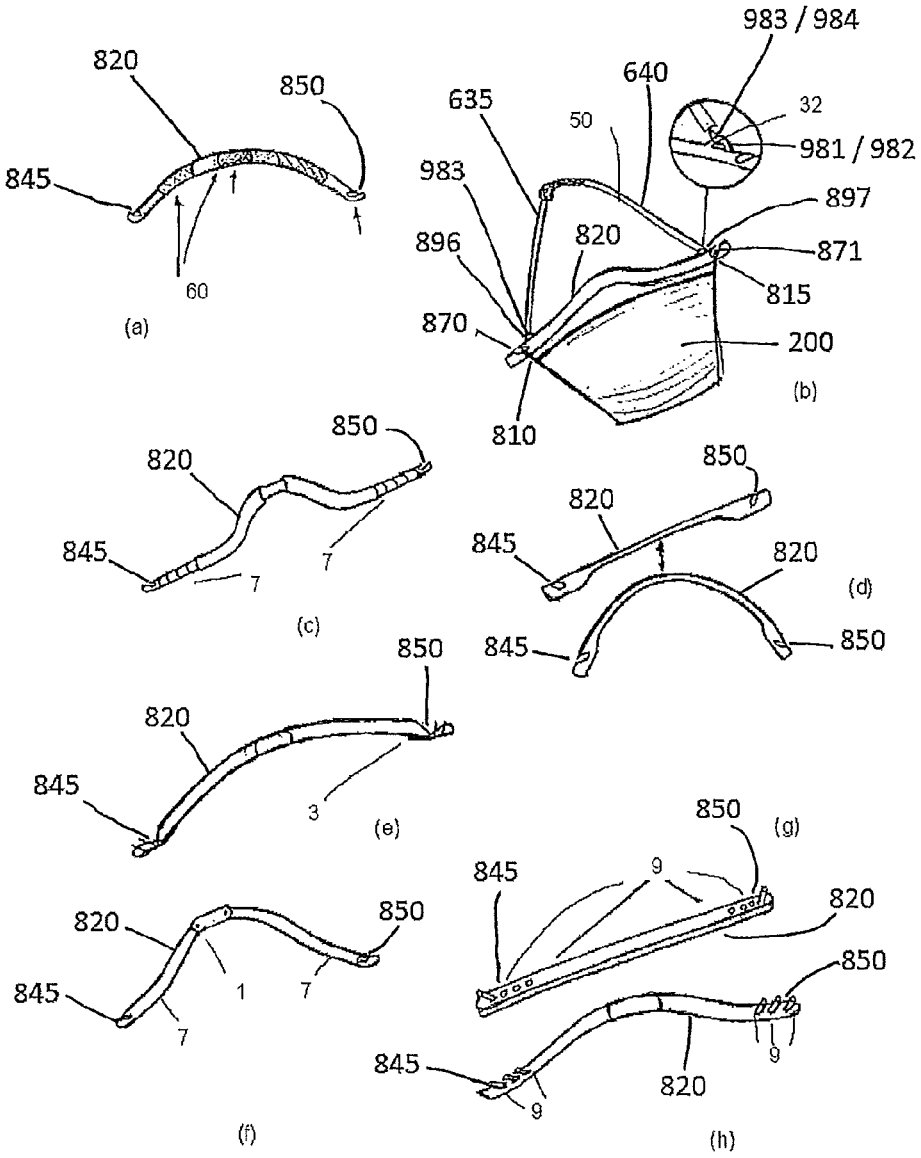
FIG. 6(*a*) to (*f*) depicts side views of further preferred embodiments of the present invention, and FIG. 6(*g*) to (*h*) also shows further preferred embodiments of the present invention.

FIG. 6(*a*) to (*f*) shows further possible modified embodiments of the carry handle.

FIG. 6(*a*) shows a version having plastic or rubber coating to provide grip. The handle can also be slightly or moderately flexible. This version can have the carry handle made different materials over its length with the centre portion being stiffer material such as plastic joined to a more flexible material such as rubber for the ends to provide adjustment in length by flexibility.

FIG. 6(*b*) shows the addition of a shoulder strap 50 attached to shoulder attachment loops 30 at the handle ends. FIG. 6(*c*) shows a version with telescopic engagement sections 7 to allow use with various sized tubs and east of storage/transport of the carry handle. FIG. 6(*d*) shows a flexible handle version which is straight when not in use. FIG. 6(*e*) shows a handle with metal end sections having the engagement means/notches, the metal end sections being attached to a handle body made from other material such as plastic or timber. FIG. 6(*f*) shows a handle version with the engagement section 7 hingedly attached to the grip portion 1 and lockable thereto when desired. FIG. 6(*g*) shows a handle version where the carry loop engagement means are pegs 9 in the engagement sections 7 instead of notches, with the pegs being adjustable in position along the handle body by the body having spaced holes. FIG. 6(*h*) is an example similar to FIG. 1 but where the engagement sections 7 are fixed spaced pegs 9 instead of notches.

Figure 7:
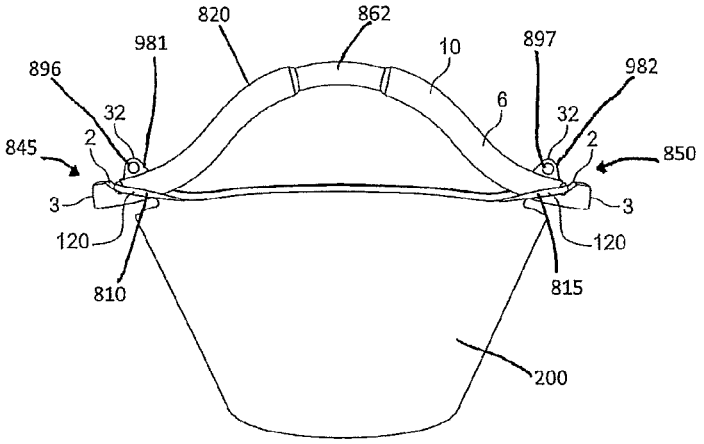
FIG. 7(*a*) and (*b*) depicts a side view and a perspective view respectively of a further preferred embodiment, whilst in use.
Figure 7:
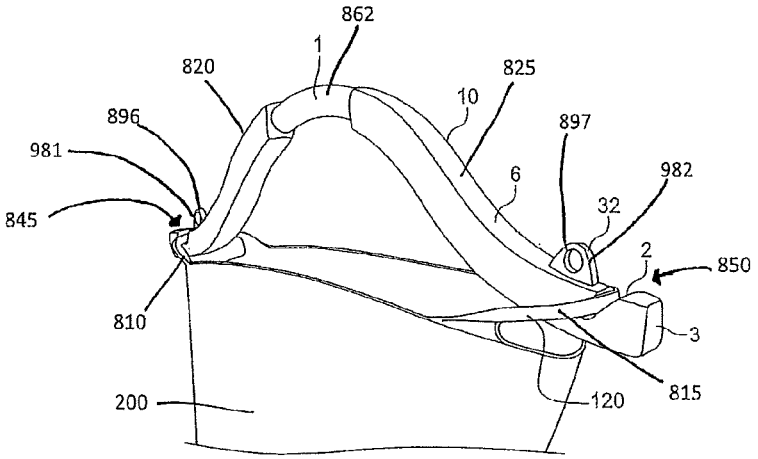

FIG. 7 shows a further preferred embodiment of the carry handle 10 in use. This carry handle 10 is similar to the embodiment shown in FIG. 7 and comprises an elongated body 6 having a central grip portion 1 and opposite ends 3. This carry handle 10 however comprises only one notch 2 adjacent each end 3. This carry handle 10 further comprises a shoulder strap attachment means 33 adjacent each notch 2, being a protrusion with an aperture. Each notch 2 is disposed between the handle attachment means 32 and the respective end 3.

In a further preferred embodiments of the present invention, as illustrated in FIGS. 8, 9, 10 and 11, there may be provided a device 800 for carrying a flexible tub 200 having a first hoop handle 810 and a second hoop handle 815. The device 800 may comprise an elongate member 820. The elongate member 820 may have any shape in which the length of the elongate member may be relatively longer than the width of the elongate member. The elongate member 820 may have an upper surface 825 and a lower surface 830 and the elongate member 820 may have a first end 835 and a second end 840. The first end 835 may comprise a first security means 845 and the second end 840 may comprise a second securing means 850. The first securing means 845 may be adapted to receive the first hoop handle 810, when in use, and the second securing means 850 may be adapted to receive the second hoop handle 815, when in use.

Preferably, the flexible tab 200 is deformable when the first loop handle 810 and the second loop handle 815 are stretched apart using the user's hand pressure. When at the rest the circumference of the flexible tub 200 is round or circular. When deformed, the diameter between the handles 810 and 815 is stretched or elongated to a maximal deformable length which is the maximum length between the handles that can be achieved by user hand pressure without damaging the flexible tub 200.

It may be preferred that the device 800 may be adapted to engage a maximum of only one flexible tub 100 at any period of time. The first securing means 845 may be postponed on the upper surface 825, and the second securing means 845 may be positioned on the upper surface 825. The elongate member 820 may be adapted to bend and be resiliently biased to absorb load of the flexible tub 100. It may be appreciated that when the device 800 engaged with a flexible tub 100 may be lifted, the weight of the flexible tub 100, with or without a load in the flexible tub 100, may apply a downward force to the first end 835 and the second end 810 of the elongate member 820. The first end 835 and/or the second end 840 of the elongate member 820 may bend towards the flexible tub 100. The elongate member 820 may deflect for a given load and the elongate member's length may be driven by the size and/or shape of the cross section and/or the tensile modulus of the thermoplastic material.

The middle portion 855 of the elongate member 820 may include a handle 860 which can be adapted to be gripped by a user, when in use. The handle grip 862 may have a surface texture that may be adapted for gripping by a user's hand. The surface texture may be of a type chosen from at least one of: round hand grip, flat hand grip, contour nubbed grip, and contour ribbed grip. The elongate member's stress which may have been developed under a given load and/or elongate member length may be driven by the size and/or shape of the cross section. It may be independent of the tensile modulus of the material used. The middle portion may be reinforced with at least one strengthen or reinforcement elements which preferably are integrally moulded into the preferred embodiment.

Figure 9:
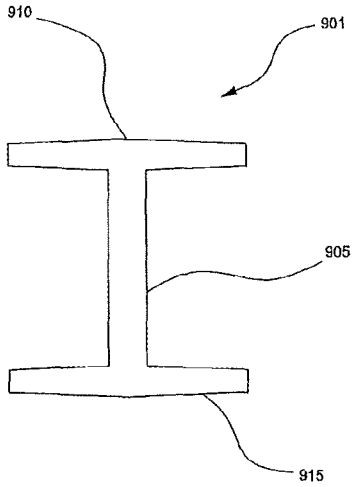
FIG. 9(*a*) depicts a cross sectional view of a first or second end of the preferred embodiment of FIG. 8.
Figure 9:
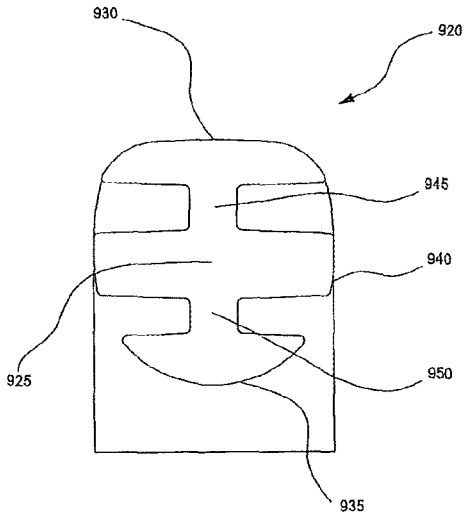

As depicted in FIG. 9(*a*), the first and/or second ends 835, 840 of the elongate member 820 may have a first 'I' beam cross section 901. The shape of the first 'I' beam cross section 901 may have a central beam portion 905 in engagement with an upper T section 910 and a lower T section 915. The upper T section 910 and the lower T section 915 may flank the ends of the central beam portion 905. The upper T section 910 and the lower T section 915 may be parallel with respect to each other and the web portion 915 may be perpendicular with respect to the upper and lower T section 910, 915. The 'I' beam cross section 901 may significantly increase the overall strength of the elongate member 820.

As illustrated in FIG. 9(*b*), the handle grip 862 may have a second 'I' beam cross section. The second 'I' beam cross section 2902 of the handle grip 862 may be similar to the first 'I' beam cross section 901 of the first and/or second ends 835, 840 of the elongate member 820. It may be preferred that the middle of the second 'I' beam cross section 920 may have an additional '+' profile 925. The second 'I' beam cross section 920 may have a top flange 930, a bottom flange 935, and a middle flange 940. Further, the second 'I' beam cross section 920 may have a top web portion 945 in engagement with the top flange 930 and the middle flange 940, and there may have a bottom web portion 950 in engagement with the bottom flange 935 and the middle flange 940. It may be preferred that the thickness of the middle flange 940 may be thicker compared to the top flange 930 or the bottom flange 935 such that it provides more rigidity and structural integrity to the handle grip 862. It may be preferred that the handle grip 862 may be strengthened so that the handle grip 862 may be more resistant to bending, when in use. It may also be preferred that the handle grip 862 may be less flexible compared to the first and/or second ends 835, 840 of the elongate member 820.

The device 800 may be constructed of one thermoplastic material selected from the following group: polypropylene, glass fibre reinforced polypropylene, poly(hexano-6-lactam), glass fibre reinforced poly(hexano-6-lactam), acrylonitrile butadiene styrene, a blend of polycarbonate and acrylonitrile butadiene styrene, glass fibre reinforced blend of polycarbonate and acrylonitrile butadiene styrene and high density polyethylene. It may be preferred that the thermoplastic may be impact modified polypropylene, glass fibre reinforced poly(hexano-6-lactam) or glass fibre reinforced blend of polycarbonate and acrylonitrile butadiene styrene. It may also be preferred that the glass fibre may be present in a range between 20 to 50 weight percentage in the glass fibre reinforced polypropylene or glass fibre reinforced poly(hexano-6-lactam), or glass fibre reinforced blend of polycarbonate and acrylonitrile butadiene styrene. It may be more preferred that the glass fibre may be present at 33 weight percentage in the glass fibre reinforced poly(hexano-6-lactam) for the device 800 constructed from glass fibre reinforced poly(hexano-6-lactam). It may also be more preferred that the glass fibre may be present at 20 weight percentage in the glass fibre reinforced blend of polycarbonate and acrylonitrile butadiene styrene for the device 800 constructed from glass fibre reinforced blend of polycarbonate and acrylonitrile butadiene styrene. The glass fibre reinforced blend of polycarbonate and acrylonitrile butadiene styrene may be selected from a grade of WP-1100 or WP-1200. An advantage of constructing the device 800 from a blend of polycarbonate and acrylonitrile butadiene styrene is that the blend may have a synergistic effect resulting in better impact resistance at the same temperature compared to the impact resistance of polycarbonate or acrylonitrile butadiene styrene alone.

It may be preferable that the device can be manufactured by injecting the thermoplastic material into a mould. For the range of thermoplastic materials, the deflection may be driven by the individual material flexural modulus. When the device 800 may have the same load imposed on the device 800, the degree of deflection of the device 800 may be different with respect to the thermoplastic material used in constructing the device 800. For the same load imposed on the device 800, the deflection for the device 800 constructed from polypropylene may be greater compared to the deflection for the device 800 constructed from poly(hexano-6-lactam), while the deflection for the device 800 constructed from poly(hexano-6-lactam) may be greater compared to the deflection for the device 800 constructed from glass fibre reinforced poly(hexano-6-lactam). For the same load imposed on the device 800, the defection for the device 800 constructed from the blend of polycarbonate and acrylonitrile butadiene styrene, may be greater compared to the deflection for the device 800 constructed from glass fibre reinforced blend of polycarbonate and acrylonitrile butadiene styrene. It may be an advantage to have glass fibre reinforcement to the thermoplastic materials such that the glass fibre may mechanically enhance the strength of thermoplastics. Furthermore, glass fibre reinforced thermoplastic materials may be more resistive to deforming forces, compared to thermoplastic materials that are not reinforced with glass fibre.

The device 800 may have a first securing means 845 at the first end 835 of the elongate member 820, in which the first securing means 845 may be a cavity 870. The first cavity 870 may be positioned on the upper surface 825 of the first end 835. The first cavity 870 may have a first cavity opening 875 that may be oblique with respect to the longitudinal axis of the elongate member 820. The first securing means 845 may have any shape with a cross section suitable for retaining a first hoop handle 810. The first cavity 870 may have a first elliptical profile wherein the first apex 880 of the first cavity 870 may be positioned towards the middle portion 855 of the elongate member 820. The first cavity wall 885 may define the first cavity 870, and when in use, the first cavity opening 875 may be adapted to receive with the first hoop handle 810 of the flexible tub 100, and the first hoop handle 810 in the first cavity 870 may engage with the first cavity wall 885.

Similarly, the device 800 may have a second securing means 850 at the opposed second end 840 of the elongate member 820, in which the second securing means 850 may be a second cavity 871, which may the same or similar to the first cavity 870. The second cavity 871 may be positioned on the upper surface 825 of the second end 840. The second cavity 871 may have a second cavity opening 876 that may be oblique with respect to the longitudinal axis of the elongate member 820. The second cavity opening 876 may be directly away from the first cavity opening 875. The second securing means 850 may have any shape with a cross section suitable for retaining a second hoop handle 815. It will be appreciated that the cross sectional shape of the second securing means 850 may or may not be the same cross sectional shape of the first securing means 845. The second cavity 871 may have a second elliptical profile wherein the second apex 881 of the second cavity 870 may be positioned towards the middle portion 855 of the elongate member 820. The second cavity wall 886 may define the second cavity 871, and when in use, the second cavity opening 876 may be adapted to receive the second hoop handle 815 of the flexible tub 100, and the second hoop handle 815 in the second cavity 871 may be adapted to engage with the second cavity wall 886.

The first securing means 845 may have a first boss 890 positioned at the first cavity opening 875, and wherein the second securing means 850 may have a second boss 891 positioned at the second cavity opening 876. The first and second bosses 890, 891 may be integrally formed with the respective first and second cavity walls 885, 886 such that the first boss 890 may be partially protruding into the first cavity 870, and the second boss 891 may also be partially protruding into the second cavity 871. The first boss 890 and the second boss 891 may each have a rounded face or profile. A first hook curve 894 may be formed from the first cavity wall 885 and the curve of the first boss 890. Similarly, a second hook curve 895 may be formed from the second cavity wall 886 and the curve of the second boss 891. When in use, the first and second hook curves 894, 895 from the respective first and second bosses 890, 891 may prevent the respective first and second hoop handles 810, 815 of the flexible tub 100 from sliding out of the respective first and second cavity 870, 871.

Figure 13A:
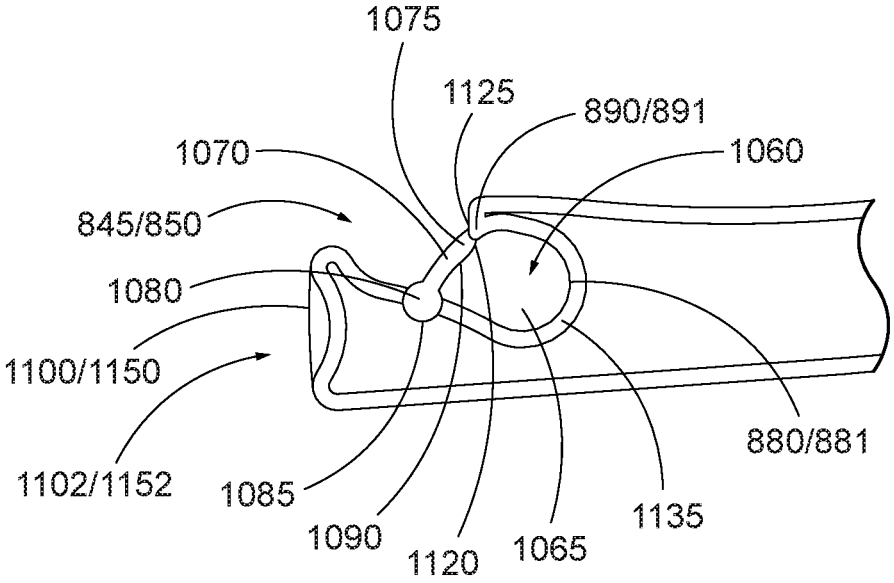
FIG. 13(*a*) depicts a side view of a first or second end of a further preferred embodiment.
Figure 13B:
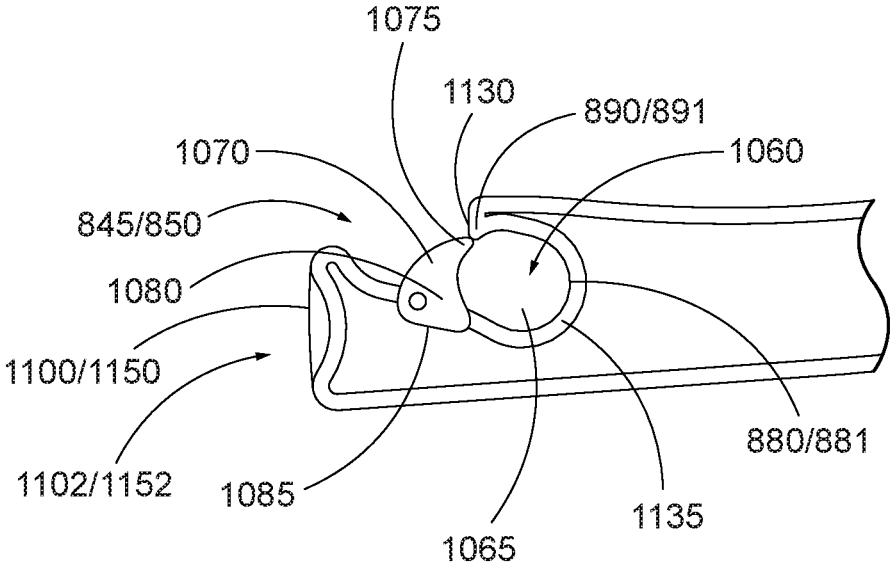

In another preferred embodiment of the device 800, as illustrated in FIGS. 13(*a*) and (*b*), it may be appreciated that the first securing means 845 or second securing means 850 may each have a hoop handle retaining means 1060 within the first or second cavity 870, 871. The hoop handle retaining means 1060 may be a retaining cavity 1065 positioned within the first or second cavity 870, 871. The retaining cavity 1065 may have a flap 1070 extending across the respective first or second cavity 870, 871. The flap 1070 may have a first flap end 1075 and a second flap end 1080. The first flap end 1080 may be in engagement with the respective first or second boss 890, 891, and the second flap end 1080 may be in engagement with the first or second cavity wall 885, 886.

It may be preferred that the first or second cavity wall 885, 886 may have a cavity wall notch 1085, in which the cavity wall notch 1085 may be adapted to receive the second flap end 1080. As illustrated in FIG. 13(*a*), the second flap end 1080 may have a curved profile such that the second flap end 1080 may pivot at the cavity wall notch 1085. While the second flap end 1080 may be able to pivot at the cavity wall notch 1085, the first flap end 1075 may have a flap notch 1090, in which the flap notch 1090 may be adapted to receive the first or second boss 800, 801. The flap notch 1090 may have a first corner 1120 and a second corner 1125. The first corner 1120 may protrude into the retaining cavity 1065, while the second corner 1125 may protrude away from the retaining cavity 1065. In this type of flap 1075, the first or second boss 890, 891 may provide a resistive force to the first corner 1120 when the first or second hoop handles 810, 815 may be pushing against the flap 1075 when the hoop handles 810, 815 are retained in the hoop handle retaining means 1060. The first or second boss 890, 891 may also provide a resistive force to the second corner 1125 when the user may push the first or second hoop handles 810, 815 into the retaining cavity 1065.

As illustrated in FIG. 13(*b*), the first flap end 1075 may not have a flap notch to receive the first or second boss 890, 891 as depicted in FIG. 13(*a*). It may be preferred to have a space 1130 between the first flap end 1075 and the first or second boss 800, 891. The space 1130 may be smaller than the thickness of the first or second hoop handles 810, 815 of the flexible tub 100. The first or second boss 890, 891 may not provide a resistive force to this type of flap. It may be preferable for the user to use less force to push the hoop handles 810, 815 into the retaining cavity 1065 in this type of flap.

For both types of flaps as illustrated in FIGS. 13(*a*) and (*b*), the retaining cavity 1065 may have smaller circular or elliptical profile compared to the elliptical profile of the first or second securing means 845, 850, in which the first or second apex 880, 881 of the respective first or second securing means 845, 850 is common with the apex 1135 of the elliptical profile of the retaining cavity 1065. When in use, the hoop handle retaining means 1060 may provide a resistive force to prevent the respective first and second hoop handles 810, 815 of the flexible tub 100 from sliding out of the respective first and second cavity 870, 871.

The flap 1070 as illustrated in FIGS. 13(*a*) and (*b*) may be constructed from a flexible and resilient material which may allow a user to use a force directed towards the retaining cavity 1065 to push the first or second hoop handles 810, 815 past the first flap end 1075 into the respective retaining cavity 1065. For disengaging the retained first or second hoop handles 810, 815 from the respective retaining cavity 1065, the user may use a force directed away from the retaining cavity 1065 to push the first or second hoop handles 810, 815 past the first flap end 1075 out of the respective retaining cavity 1065. It may be preferred that the force to push the first or second hoop handles 810, 815 out of the respective retaining cavity 1065 may be equal or greater than the force to push the first or second hoop handles 810, 815 into the respective retaining cavity 1065.

In a further preferred embodiment, the flap 1070 may be relatively rigid and mounted on a hinge or pivot as shown in FIG. 13(*b*). The pivot may allow the flap 1070 to be deflected to allow the handle of the tub pass through it and then the flap may automatically return the its original position. The automatic return of the flap may be achieved by the use a spring biased arrangement working around the hinge or pivot, the spring bias or spring may return the flap to a sealed configuration when at rest.

Figure 8:
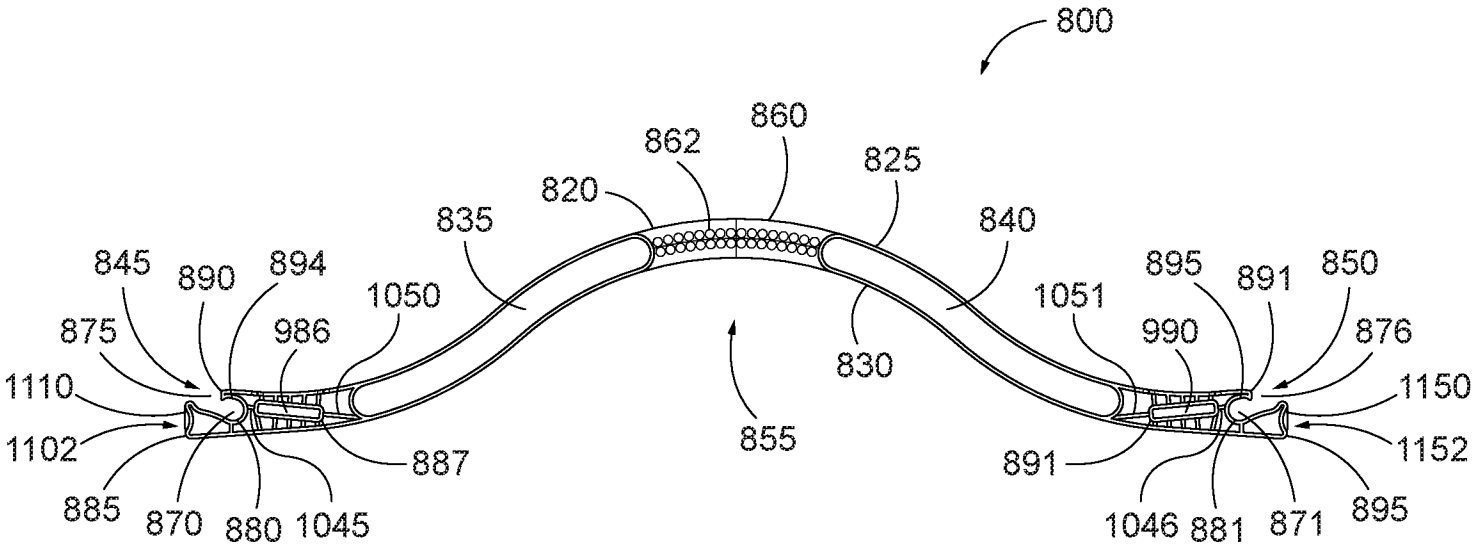
FIG. 8 depicts a side view of another further preferred embodiment.
Figure 10:
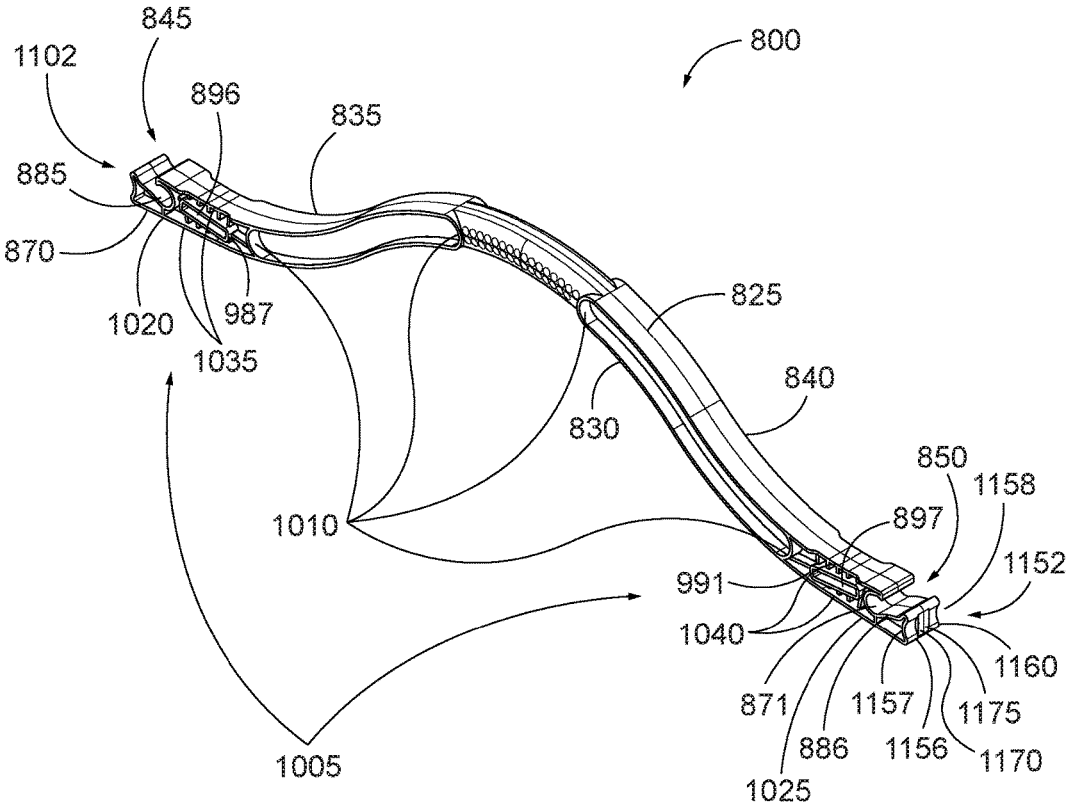
FIG. 10 depicts a perspective view of the preferred embodiment of FIG. 8.
Figure 11:
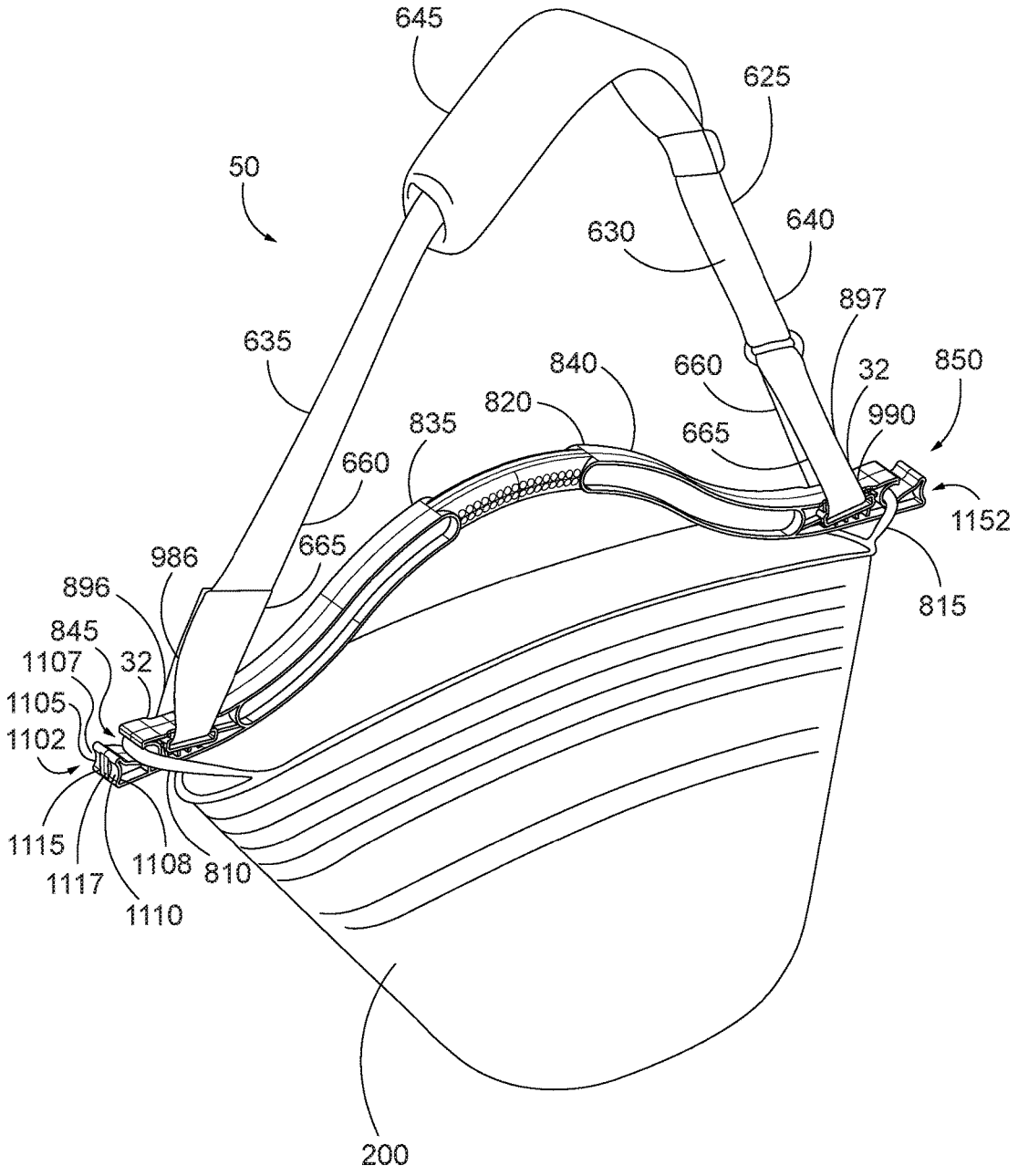
FIG. 11 depicts a perspective view of the preferred embodiment of FIG. 8, whilst in use with a flexible tub and a shoulder strap.

For users who may prefer to carry the device 800 over the user's shoulder, the elongate member 820 may have shoulder strap attachment means 32 to engage with a shoulder strap 50. As illustrated in FIG. 6 or 11, the device 800 at the first end 835 may further comprise a first strap attachment means 896. The first strap attachment means 896 or a strap connector may be positioned relatively on the upper surface 825 of the device 800, as illustrated in FIGS. 1, 5, 6(*b*), 7; or positioned between the upper surface 825 and the lower surface 830 at the first end 835 of the device 800, as illustrated in FIGS. 8, 10 and 11. The first strap attachment means 896 may be positioned near the first cavity 870. Similarly, the elongate member 820 at the second end 840 may further comprise a second strap attachment means 897. The second strap attachment means 897 or a second strap connector, in which the second strap connection may be same or similar to the first end 835. The second strap attachment means 897 may be positioned relatively on the upper surface 825 of the device 800, as illustrated in FIGS. 1, 5, 6(*b*), 7; or positioned between the upper surface 825 and the lower surface 130 at the second end 840 of the device 100, as illustrated in FIGS. 8, 10, and 11. The second strap attachment means 897 may be positioned near the second cavity 871. The shoulder strap 50 may have a first shoulder strap end 635 and a second shoulder strap end 640.

As illustrated in FIG. 6(*b*), the first shoulder strap end 635 may have a first shoulder strap clip 983, and the second shoulder strap end 640 may have a second shoulder strap clip 984. The first and second shoulder strap clips 983, 984 may be adapted to engage with the respective first 896 and second strap connectors 897, as illustrated in FIG. 6(*b*). The strap clips 983, 984 may allow a shoulder strap 50 to be removably coupled to the respective first 896 and second strap connectors 897, as illustrated in FIG. 6(*b*). It may be preferable that the first strap clip 983 and a second strap clip 894 may be adapted to interlink with the first strap connector 896 and the second strap connector 897 respectively. The first and second strap clip 983, 984 may be any of type of clasp 985. As illustrated in FIG. 5(*e*), for example, the clasp 985 may be a lobster clasp that can be removably coupled to the respective first and second strap connectors 896, 897. The first strap connector 896 may have a first strap connector hoop portion 891 that may be adapted to allow the first strap clip 983 to interlink. Similarly, the second strap connectors 897 may have a second strap connector hoop portion 982 that may be adapted to allow the second strap clip 984 to interlink.

In another embodiment as shown in FIG. 5(*e*), the clasp may be engaged with the snap attachment means of the elongate member 810. This embodiment may be used for a shoulder strap 50 that may have a first clasp receiving means and a second clasp receiving means at the first shoulder strap end 635 and the second shoulder strap end 640 respectively. It would be appreciated that not all shoulder straps 50 have similar strap ends and it may be an advantage to be able to engage different attachment means to the elongate member 820 such that different strap ends can also be used.

In another embodiment of the device 800 as illustrated in FIGS. 8, 9, 10, and 11, the first strap attachment means 806 may be a first slot 986, and the second strap attachment means 897 may be a second slot 990. The first and second slots 986, 990 may each have a shape that can be adapted to engage with the first shoulder strap end 635 and the second shoulder strap end 640. As shown in FIG. 11, the shoulder strap 50 may have an upper strap surface 625 and a lower strap surface 630. The shoulder strap may further comprise a padded middle section 645 for engaging with the user's shoulder. Either the upper strap surface 625 or the lower strap surface 630 may have a patch of first hook fasteners 650 and a patch of first loop fasteners 655 at the first shoulder strap end 635, and the upper strap surface 625 may have a patch of second hook fastener 660 and a patch of second loop fasteners 665 at the second shoulder strap 640. The patch of first hook fasteners 650 may be positioned relatively between the padded middle section 645 and the patch of first loop fasteners 655, and similarly, the pitch of second hook fasteners 660 may be positioned relatively between the padded middle section 645 and the patch of second loop fasteners 665. When fastening the shoulder strap 50 to the device 800, the first shoulder strap end 635 may be positioned through the first slot 986, and secured by the engagement between the patch of first hook fasteners 650 and the patch of first loop fasteners 655; and the second should strap end 640 may be positioned through the second slot 990, and secured by the engagement between the patch of second hook fasteners 660 and the patch of second loop fasteners 665. It may be appreciated that the securing may be stronger when more of the hook fasteners are in engagement with the loop fasteners, as compared to a partial engagement. It may also be appreciated that the patches of the hoop and of loop fasteners may vary it length along the longitudinal axis of the shoulder strap 50 so that more hooks can engage with loops. Stronger securing on both the shoulder strap ends may be preferred depending on the weight of the load of the flexible tub 100.

Figure 12:
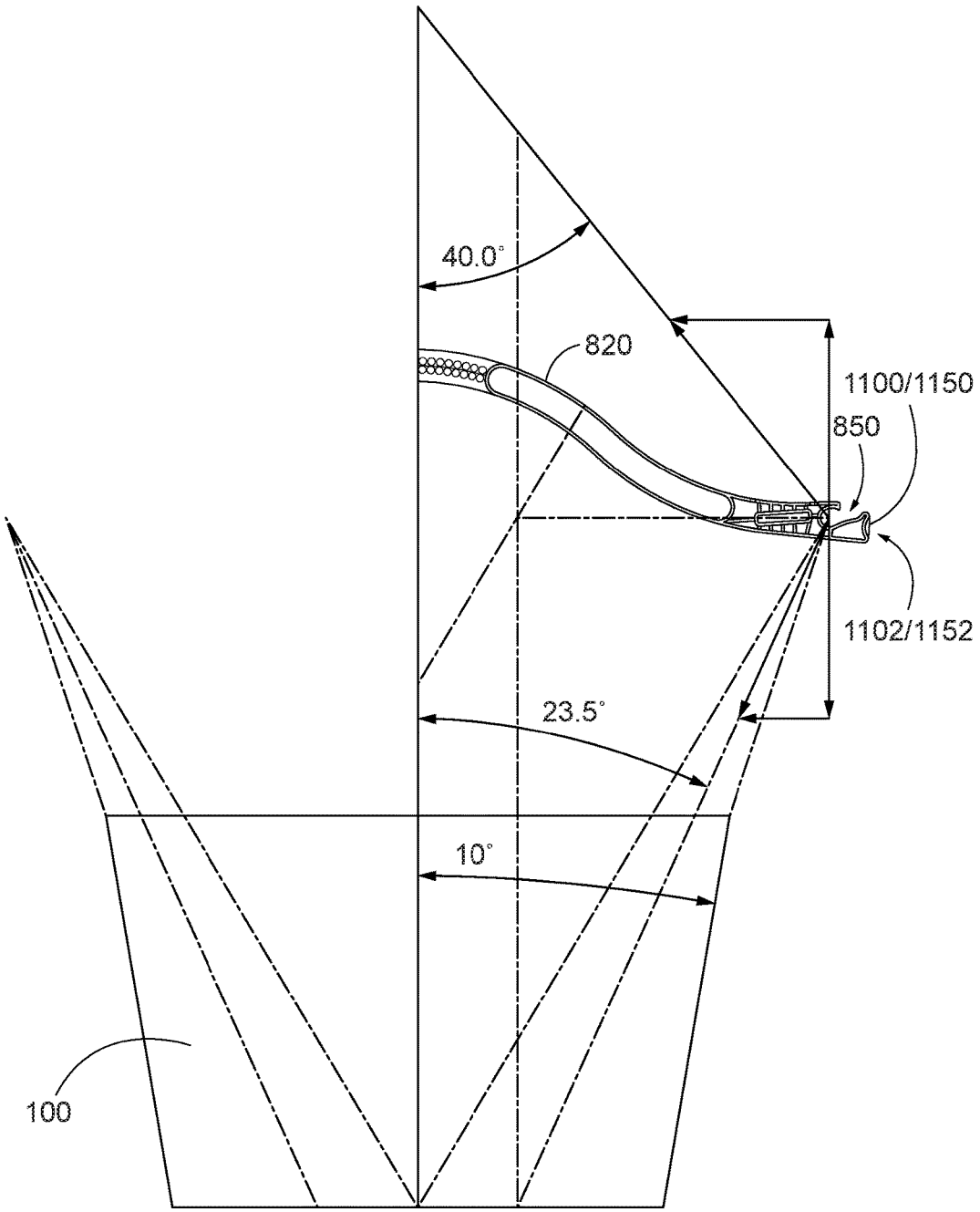
FIG. 12 depicts a cross sectional view of a preferred embodiment, whilst in use, demonstrating vector forces acting on the load of tub.

As shown in FIG. 12, the geometry of the flexible tub 100, the device 800, and the shoulder strap 50 may create a load vector geometry that may affect the loads applied to the device 800 structure. It may be preferred that the device 800 can be resilient enough to handle flexible tub loads up to 40 kg. An average person may be able to lift a load of 16 to 20 kg, and so the normal flexible tub load may preferably accommodate up to 20 kg for use with the device. It may be appreciated that the person can carry more than 20 kg and so the device may also be able to resiliently carry the flexible tub past its nominal load provided that it is 40 kg or under. The device 800 may be designed such that the handle 860 can accommodate a load of 40 kg, the shoulder strap can accommodate a load of 40 kg, and the first and second ends 835, 840 of the elongate member 820 can accommodate a load of 20 kg per end.

As shown in FIG. 8, 9, 10, 11, the shape of the first and second slots 986, 990 may be curved or round for reducing stress concentration to the corners of the slots 986, 990. For example, the shape of the slots 986, 990 may be chosen from at least one of a: circle, ellipse, oval, releaux polygon, and polygons with curved corners. It may be preferred that the first slot 986 and the second slot 990 may have an obround profile. The first slot wall 987 and the second slot wall 991 may each define the respective first and second slots 986, 990. The first slot wall 987 and the second slot wall 991 may each be integral to the elongate member 820. As such, the first and second slot walls 987, 991 of the respective first and second slots 986, 990 may also be constructed from the same material as the elongate member 820. The first slot 986 and the second slot 990 may be adapted to bend and may be resiliently biased to absorb the upward force when using the shoulder strap 50 to lift the elongate member 820 by the first slot 986 and the second slot 990. Further, the first slot 986 and the second slot 990 may also be resiliently biased to absorb the downward force from the weight of the flexible tub 100, when in use with the shoulder strap 50.

As illustrated in FIG. 8, 9, 10 and 11, the first 835 and/or second ends 840 of the elongate member 820 may have a plurality of structural reinforcement means 1005, in which the plurality of structural reinforcement means 1005 may be at least one elongate member support 1010 for supporting the elongate member 820. The at least one elongate member support 1010 may connect between the lower surface 830 of the elongate member 820 and the upper surface 825 of the elongate member 820. The at least one elongate member support 1010 may provide more rigidity and/or structural integrity to the first end 835 and the second end 840 of the elongate member 820.

For additional structural support, the first securing means 845 may have at least one cavity support means 1015 for the first cavity 870 relatively beneath the first cavity wall 885. As shown in FIG. 10, the first cavity support 1020 may connect between the lower surface 830 at the first end 835 of the elongate member 820 and the first cavity wall 885. Similarly, the second securing means 850 may have at least one cavity support means 1015 for the second cavity 871 relatively beneath the second cavity wall 886. The second cavity support 1025 may connect between the lower surface 830 at the second end 840 of the elongate member 820 and the second cavity wall 886. The at least one cavity support means 1015 may provide more rigidity and/or structural integrity to the first cavity wall 885 and the second cavity wall 886. The extra support may increase the resilience of the elongate member 820 to bias and absorb the load of the flexible tub 100.

In another embodiment of the device 800, as shown in FIG. 8, there may be a plurality of structural reinforcement means 1005. The first strap attachment means 896 may also be structurally reinforced with at least one first strap attachment support 1035, and the second strap attachment means 897 may also be structurally reinforced with at least one second strap attachment support 1040. As illustrated in FIGS. 8 and 10, the first strap attachment supports 1035 may connect between the lower surface 830 at the first end 835 of the elongate member 820 and the first slot wall. The first strap attachment supports 1035 may also connect between the upper surface 825 at the first end 835 of the elongate member 820 and the first slot wall 987. Similarly, the second strap attachment supports 1040 may connect between the lower surface 830 at the second end 840 of the elongate member 820 and the second slot wall 991. The second strap attachment supports 1040 may also connect between the upper surface 825 at the second end 840 of the elongate member 820 and the second slot wall 991. The structural reinforcement means 1005 below the first slot and below the second slot 990 may provide support from the downward force of the flexible tub 100. The structural reinforcement means 1005 above the first slot 986 and above the second slot 990 may increase the resilience of the elongate member 820 to bias and absorb the upward force of the shoulder strap 50, when in use.

For further additional structural support to the elongate member 820, there may also be a first truss web 1045 which may be adapted to engage between the first cavity wall 885 and the first slot wall 987, and a first oblique support 1050 which may be adapted to engage between the lower surface 835 and the first slot wall 987. As shown in FIG. 8, the first truss web 1045 and the first oblique support 1050 may both be oblique with respect to the first strap attachment support 1035. Similarly, there may also be a second truss web 1046 which may be adapted to engage between the second cavity wall 886 and the second slot wall 991, and a second oblique support 1051 which may be adapted to engage between the lower surface 835 and the second slot wall 991. The second truss web 1046 and the second oblique support 1051 may both be oblique with respect to the second strap attachment support 1040.

In another embodiment of the device 800, the first end 835 of the elongate member 820 may be symmetrical relative to the second end 840 with respect to the vertical axis of the middle of the elongate member. The symmetry of the elongate member may evenly distribute the load impact of the flexible tub 100 between the first end 835 and the second end 840. The elongate member 820 may have a curved profile. It may be preferred that the elongate member 820 may have a partially sinusoidal profile. The sinusoidal profile may assist with allowing the device to slightly or partially bend under load.

In another embodiment of the device 800 as shown in FIG. 3, it may be appreciated that the elongate member 820 may be in different lengths to adapt to receive different sized flexible tubs 100 with a first hoop handle 810 and a second hoop handle 815. It may be appreciated that the elongate member 820 may have different curves that may or may not be a sinusoidal profile, which is also illustrated in FIG. 5(*a*) to (*d*).

In another embodiment of the device 800 as shown in FIG. 4(*a*), it may be appreciated that the elongate member 820 with a first cavity 870 and a second cavity 871 may have similar profiles as shown. Similar to the description and/or purpose of a first boss 890 and a second boss 891, there may be a flexible locking flap 15 positioned at the first or second cavity 870, 871 such that the first or second hoop handles 810, 815 adapted to be received in the respective cavities 870, 871 may not easily come out of the respective cavity. As illustrated in FIG. 4(*b*), the first cavity cross section 878 and/or the second cavity cross section 879 may have similar profiles as shown. The first and second cavity walls 885, 886 may be curved such that stress concentrations to the cavity wall may be reduced.

As illustrated in FIG. 2(*a*), when the flexible tub 100 may not be engaged with the device 800, the flexible tub 100 may have a resting diameter. The opening of the resting flexible tub 100 may have a circular or an elliptical profile. As illustrated in FIG. 2(*b*), once the first and second hoop handles 810, 815 of the flexible tub 100 may be engaged with the first and second securing means 845, 850 of the device 800, the first handle 810 and the second handle 815 of the flexible tub 100 may be moved apart with respect to each other. When the handles 810, 815 may be moved apart, the body of the flexible tub 100 may change to a deformed flexible tub 200. The resting diameter of the deformed flexible tub opening 205 may change. For example, a circular opening or an elliptical opening of the restring flexible tub 100 may change to a narrower elliptical opening profile of the deformed flexible tub 200, in which the major axis of the narrower elliptical opening profile of the deformed flexible tub 200 may be longer than the major axis of the elliptical opening of the resting tub 100, and the minor axis of the narrower elliptical opening profile of the deformed flexible tub 200 may be shorter than the minor axis of the elliptical opening of the resting flexible tub 100. When the device 800 may be engaging with the hoop handles 810, 815 of the resting flexible tub 100, the narrower elliptical opening profile may have an advantage of preventing the load and/or contents in the deformed flexible tub 200 from coming out of the deformed flexible tub opening 205. When the first and second handles 810, 815 are moved apart, past the first apex of the deformed flexible tub opening 210 and the second apex of the deformed flexible tub opening 215, the narrower elliptical opening profile may have a maximum diameter along the major axis. The maximum diameter may be parallel to the longitudinal axis of the elongate member 820, and the maximum extended diameter of the tub is preferably greater than the length of the elongate member 820. Whilst the resting diameter of the tub may be shorter of the length of the elongate member 820. This may allow the preferred embodiment to engage the tub only when the flexible tub is deformed in an extended diameter configuration. When a load is placed in the tub, the tub handles are pulled downwards and towards the centre of the tub which in turn increases the engagement force applied by the handles on the preferred embodiment.

In another preferred embodiment of the device 800, as illustrated in FIG. 1(*b*) to (*d*), the elongate member 820 may have a plurality of securing means 220 along the longitudinal axis of elongate member 820. The plurality of the securing means 220 at the first end 835 and the second end 840 may be a plurality of first cavities 225 and a plurality of second cavities 230 respectively. Each of the first cavities 870 and each of the second cavities 871 may all have an elliptical profile, each of the cavities may each have an apex 880, 881 directed towards the centre of the elongate member 820. It may be preferred that each securing means of the plurality of first securing means 845 may be spaced apart with respect to each other. It may also be preferred that each of the plurality of the first securing means 845 may all have first cavity openings on the upper surface 835 of the elongate member 820. Similarly, it may also be preferred that each of the plurality of the second securing means 850 may all have second cavity openings on the upper surface 835 of the elongate member 820.

It may be preferred that the first end 835 and the second end 840 of the elongate member 820 may be symmetrical with respect to the vertical axis of the elongate member 820. It may be appreciated that the flexible tub 100 may have different sizes and so a smaller flexible tub with hoop handles 810, 815 may be placed in the respective securing means 845, 850 that are closer to the middle portion of the elongate member 855 compared to a larger sized flexible tub. An advantage of the device 800 with a plurality of securing means 220 along the first end 835 and the second end 880 may be that only one device 800 may be suitable to carry a different sized flexible tub at a time.

In another embodiment of the device 800, as illustrated FIGS. 5 and 7, the first strap attachment means 800 may be positioned on the first end 838 of the elongate member 820, and the second strap attachment means 897 may be positioned on the second end 840 of the elongate member 820. It may be preferred that the first strap attachment means 896 may have a first strap connector hoop portion 981 that may be adapted to engage with the first shoulder strap end 635. Similarly, it may be preferred that the second strap attachment means 897 may have a second strap connector hoop portion 982 that may be adapted to engage with the second shoulder strap end 640.

The first strap attachment means 896 may be positioned at the upper surface 825 between the first securing means 845 and the middle portion of the elongate member 855. It may be preferred that the first strap attachment means 896 may be positioned closer to the first securing means 845 than the middle portion of the elongate member 855. Similarly, for the second strap attachment means 897, it mat be preferred that the second strap attachment means 897 may have a hoop portion that may be adapted to engage with strap end connectors. The second strap attachment means 897 may be positioned at the upper surface 825 between the second securing means 850 and the middle portion of the elongate member 855. It may be preferred that the second strap attachment means 897 may be positioned closer to the second securing means 850 than the middle portion of the elongate member 855. It may be an advantage to have the first strap attachment means 896 and the second strap attachment means 897 near the respective ends 3 of the elongate member 820.

In another preferred embodiment of the device 800, as illustrated in FIGS. 8, 10, 11, 13(*a*) and 13(*b*); the first end 835 of the elongate member 820 may have a first extremity 1110 and the second end 840 of the elongate member 820 may have a second extremity 1150. It may be preferred that the first extremity 1110 may have a first hoop handle unsecuring means 1102 and the second extremity 1150 may have a second hoop handle unsecuring means 1152.

As illustrated in FIG. 11, it may be preferred that the first hoop handle unsecuring means 1102 may comprise a primary indent 1105 and a secondary indent 1110. The primary indent 1105 may have a primary indent profile and the secondary indent 1110 may have a secondary indent profile. The primary opening of the primary indent profile 1107 may be relatively perpendicular to the longitudinal axis of the elongate member 820, and the secondary opening of the secondary indent profile 1108 may also be relatively perpendicular to the longitudinal axis of the elongate member 820. The primary opening of the primary indent profile 1107 may be facing relatively away from the secondary opening of the secondary indent profile 1108. The primary indent 1107 and the secondary indent 1108 may each have a curved shape. The curved shape may be semioval or semicircle, in which the primary apex of the primary indent profile 1115 may be facing relatively towards the secondary apex of the secondary indent profile 1117. It may be appreciated that the primary indent may be shaped to receive the user's thumb on the left hand and the secondary indent may be shaped to receive the user's thumb on the right hand. Preferably, primary indent 1105 and the secondary indent 1110 may have a concave profile when compared to the respective ends.

The indents may allow a user to depress their thumbs into the respective indents, and the remaining digits of the user's hand can be used to stretch the respective handle of the flexible tub over the respective end thereby ensuring a better or improved fit. The indents may allow the user to exert a turning moment on the hoop handle whilst stretching into place on the respective securing means. The reverse process may be applied in the reverse to allow for the disengagement of the tub handle from the respective end.

As illustrated in FIG. 10, it may also be preferred that the second extremity 1150 is the same or substantially similar to the first extremity 1100. It may be preferred that the second hoop handle unsecuring means 1152 may have a tertiary indent 1156 and a quaternary indent 1160. The tertiary indent 1156 may have a tertiary indent profile, and the quaternary indent 1160 may have a quaternary indent profile. The tertiary opening of the tertiary indent profile 1157 may be relatively perpendicular to the longitudinal axis of the elongate member 820, and the quaternary opening of the quaternary indent profile 1158 may also be relatively perpendicular to the longitudinal axis of the elongate member 820. The tertiary opening of the tertiary indent profile 1157 may be facing relatively away from the quaternary opening of the quaternary indent profile 1158. The tertiary indent profile and the quaternary indent profile may each have a curved shape. The cursed shape may be semioval or semicircle, in which the tertiary apex of the tertiary indent profile 1170 may be facing relatively towards the quaternary apex of the quaternary indent profile 1175. It may be appreciated that the tertiary indent may be shaped to receive the user's thumb on the left hand and the quaternary indent may be shaped to receive the user's thumb on the right hand. Preferably, tertiary indent 1156 and the quaternary indent 1160 may have a concave profile when compared to the respective ends.

In the hoop handle secured configuration, wherein the first hoop handle 810 and the second hoop handle 815 are received in the respective first and second securing means 845, 850, it may require a predetermined force to pull each of the hoop handles 810, 815 out of the respective securing means 845, 850. For example, for pulling out a secured first hoop handle 810, the user may position their thumbs on the first hoop handle unsecuring means 1102 at the respective primary and secondary indents 1105. 1110. The user's thumbs may exert a force towards the middle portion 855 of the elongate member 820 while the user's other fingers holding the fast hoop handle may exert a force away from the middle of the elongate member 820.

Similarly, for pulling out a received second hoop handle, the user may position their thumbs on the second hoop handle unsecuring means 52 at the respective tertiary and quaternary indents 1157, 1158. The user's thumbs may exert a force towards the middle of the elongate member 820 while the user's other fingers holding the second hoop handle 815 may exert a force away from the middle portion 855 of the elongate member. It may be appreciated that all the indents of the first and second hoop unsecuring means 1102, 1152 may be ribbed or a finishing surface for enhancing gripping and traction when the user's thumbs are positioned on the respective indents.

It may be appreciated that in using the first or second hoop handle unsecuring means 1102, 1152 the received first hoop handle 810 and the received second hoop handle 815 may not be pulled out together but for pulling one received hoop handle out before pulling the other received hoop handle out from the respective securing means 845, 850. It may be an advantage to provide a user with hoop handle unsecuring means 1102, 1152 to facilitate ergonomic removal of the secured hoop handles 810, 815.

Figure 14:
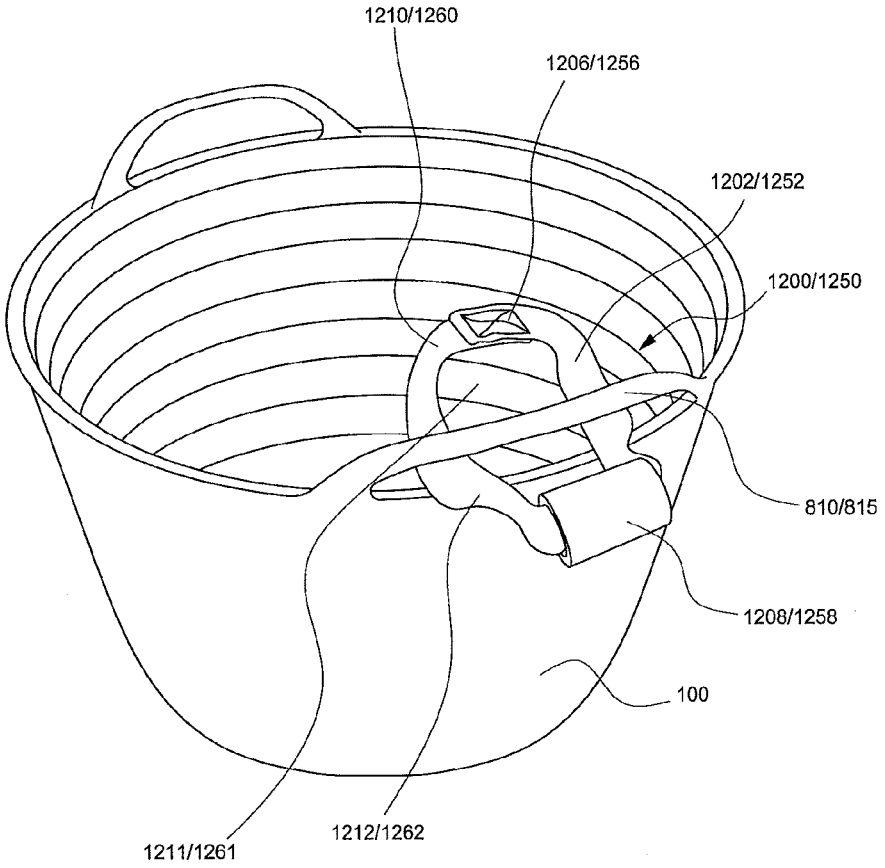
FIG. 14 depicts a perspective view of a restraining means adapted for use with the preferred embodiment of FIG. 8.
Figure 15:
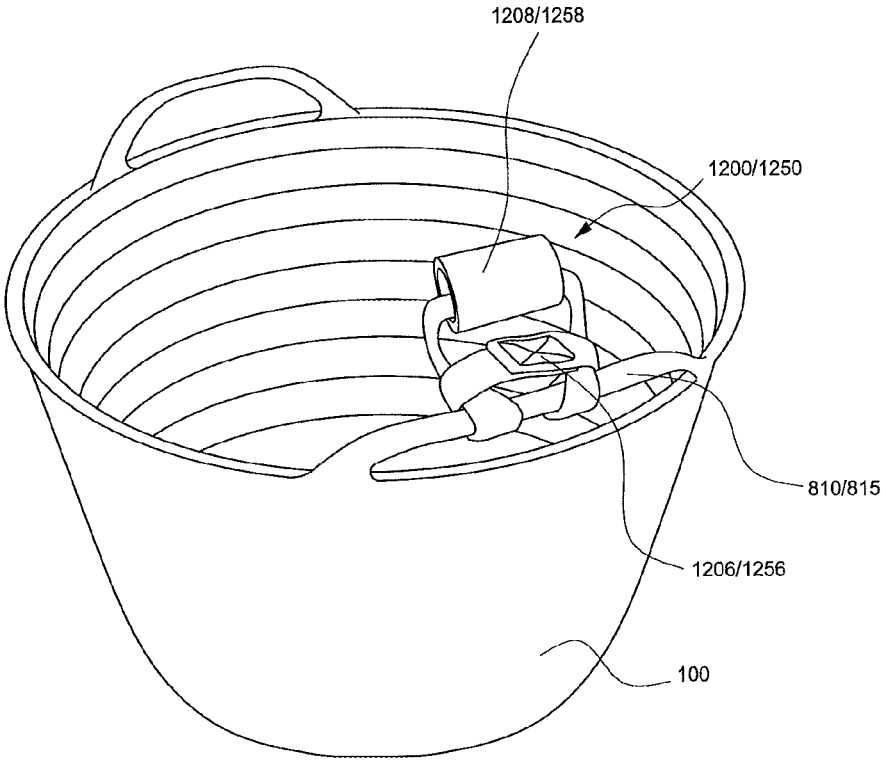
FIG. 15 depicts a perspective view of the restraining means restrained to a hoop handle of the flexible tub adapted for use with the preferred embodiment of FIG. 8.

In another preferred embodiment of the device 800, as illustrated in FIGS. 14 and 15, a first restraining means 1200 may be adapted for restraining the first securing means 845 of the device 800 to the first hoop handle 810 of the flexible tub 100; and a second restraining means 1250 may be adapted for restraining the second securing means 850 of the device 800 to the second hoop handle 815 of the flexible tub 100. The first restraining means 1200 is preferably adapted to be positioned between a respective carrying loop of the flexible tub 100 and securing means of the device 800. This restraining means may allow for greater or increased flexibility around the connection point between the device and tub.

Figure 16:
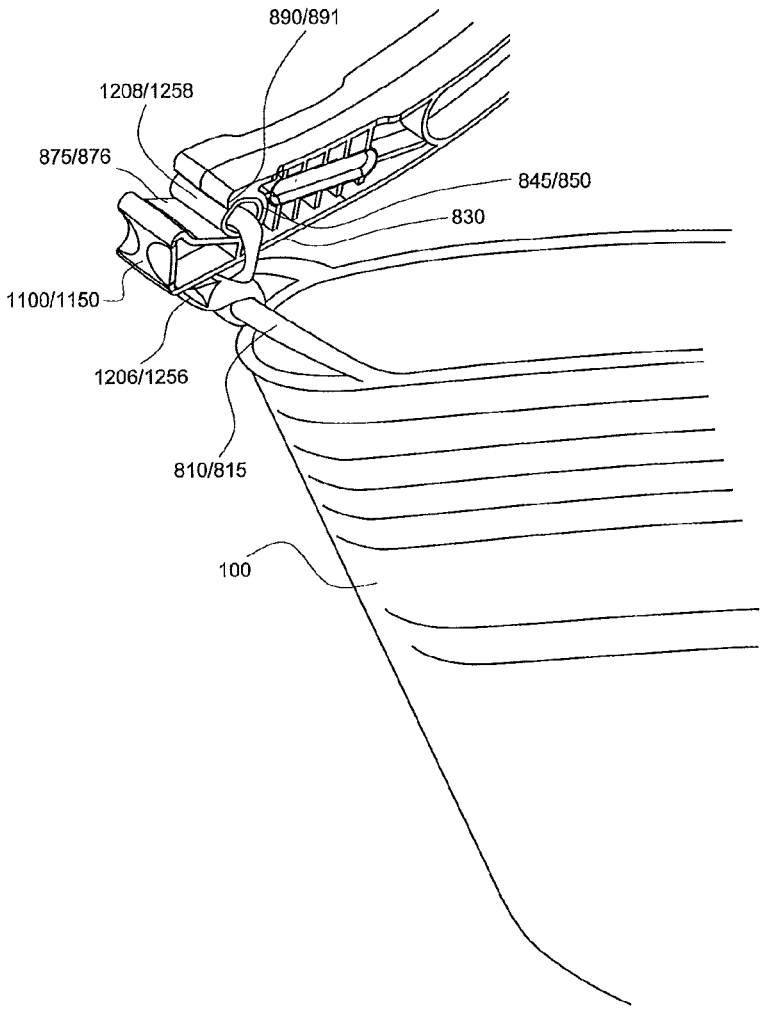
FIG. 16 depicts a perspective view of the restraining means attached to the preferred embodiment of FIG. 8.
Figure 17:
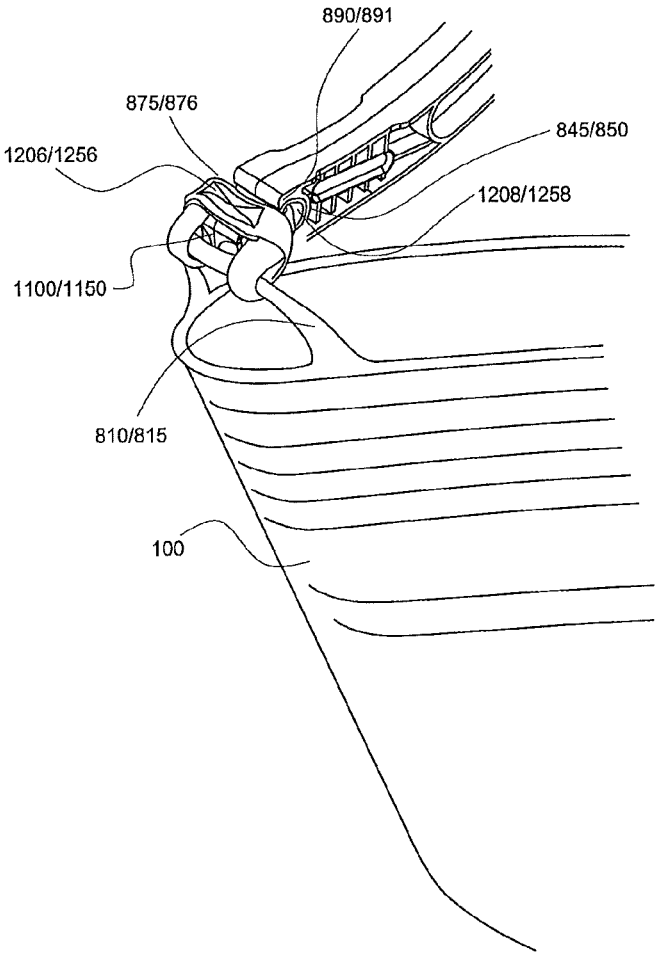
FIG. 17 depicts a further perspective view of the restraining means attached to the preferred embodiment of FIG. 8.

The first retraining means 1200 may be a first restraining strap 1202, in which the first restraining strap 1202 may comprise a first attachment means 1204 and a first latch means 1206. As illustrated in FIGS. 16 and 17, the first attachment means 1204 may have a first portion 1208 that can fit relatively flush against the wall in the first cavity 870 of the first securing means 845. The first position 1208 of the first attachment means 1204 may have a cylindrical shape, in which the first portion 1208 may be constructed from a material that can be deformable and resiliently biased to allow the first portion 1208 to deform past the first boss 890 and reform back to its original shape as the first portion 1208 may be attached in the first cavity 870. The first boss 890 may provide a predetermined restraining force to the fast portion 1208 such that the first portion 1208 when received in the first cavity 870 may not easily slip out of the first securing means 845.

The first restraining strap 1202 may be adapted to restrain the first hoop handle 810 of the flexible tub 100. The first restraining strap 1202 may have a circular or ovular profile. As illustrated in FIGS. 14 and 15, to restrain the first restraining strap 1202 to first hoop handle 810, the first restraining strap 1202 may thread through the first hoop opening of the first hoop handle 810 such that the first hoop handle 810 overhangs across the first restraining strap 1202. When the first hoop handle 810 overhangs across the first strap 1202, it may divide the first restraining strap 1202 into a proximal first restraining strap hoop portion 1210 and a distal first restraining strap hoop portion 1212. The proximal first restraining strap hoop portion 1210 may be proximal to the second hoop handle 815 of the flexible tub 100, and the distal first restraining strap hoop portion 1212 may be distal to the second hoop handle 815 of the flexible tub 100. The proximal first restraining strap hoop portion 1210 may have the first latch means 1206, and the distal first restraining strap hoop portion 1212 may have the first attachment means 1204. The distal first restraining strap hoop portion 1212 which may have the first attachment means may be used to curve over the overhanging first hoop handle 810 of the flexible tub 100 which then passes through the proximal first restraining strap hoop portion opening 1211 with the first latch means 1206. In this tied configuration, the first restraining strap 1202 may be restrained to the first hoop handle 810 of the flexible tub 100, leaving the first attachment means 1204 exposed for which the first attachment means 1204 can be adapted to receive in the first cavity 870 of the first securing means 845.

Similarly, the second renaming means 1250 may be a second restraining strap 1252, in which the second restraining strap 1252 may comprise a second attachment means 1254 and a second latch means 1256. The second attachment means 1254 may be identical or similar to the first attachment means 1204. As illustrated in FIGS. 16 and 17, the second attachment means 1254 may have a second portion 1258 that can fit relatively flush against the wall in the second cavity 871 of the second securing means 850. The second portion 1258 of the second attachment means 1254 may have a cylindrical shape, in which the second portion 1258 may be made of a material that can be deformable and resiliently biased to allow the second portion to deform past the second boss and reform back to its original shape as the second portion 1258 is attached in the second cavity 871. The second boss 891 may provide a predetermined restraining force to the second portion 1258 such that the second portion 1258 may not easily slip out of the second securing means 850.

The second restraining strap 1252 may be adapted to restrain the second hoop handle 815 of the flexible tub 100. The second restraining strap 1252 may be identical or similar to the first restraining strap 1202. The second restraining strap 1252 may have a circular or ovular profile. To restrain the second restraining strap 1252 to second hoop handle 815, the second strap may thread through the second hoop opening of the second hoop handle 815 such that the second hoop handle 815 overhangs across the second restraining strap 1252. When the second hoop handle 815 overhangs across the second restraining strap 1252, it may divide the second restraining strap 1252 into a proximal second restraining strap hoop portion 1260 and a distal second restraining strap hoop portion 1262. The proximal second restraining strap hoop portion 1260 may be proximal to the first hoop handle 810 of the flexible tub 100, and the distal second restraining strap hoop portion 1262 may be distal to the first hoop handle 810 of the flexible tub 100. The proximal second restraining strap hoop portion 1260 may have the second latch means, and the distal second restraining strap hoop portion 1262 may have the second attachment means 1254. The distal second restraining strap hoop portion 1262 which have the second attachment means may be used to curve over the overhanging second hoop handle 815 of the flexible tub 100 which then passes through the proximal second restraining strap hoop portion 1260 with the second latch means 1256. In this tied configuration, the second restraining strap 1254 may be restrained to the second hoop handle 815 of the flexible tub 100, leaving the second attachment means 1254 exposed for which the second attachment means 1254 can be adapted to receive in the second cavity 871 of the second securing means 850.

The tied configuration of the first restraining strap 1202 to the first hoop handle 810 may allow the first attachment means 1204 to pivot around the first point of restraint 1214 between the first restraining strap 1202 and the first hoop handle 810 at a direction perpendicular to the length of the first hoop handle 810. Similarly, the tied configuration of the second restraining strap 1252 to the second hoop handle 815 may allow the second attachment means 1254 to pivot around the second point of restraint 1264 between the second restraining strap 1252 and the second hoop handle 815 at a direction perpendicular to the length of the second hoop handle 815.

When attaching the first and second portion 1208/1258 to the respective first and second securing means 845/850 of the device 800, it may be an ergonomic advantage to position the first end and second end of the elongate member 835/840 through the respective first and second hoop handles 810/815 of the flexible tub 100 so that the user can use a predetermined force to push down the first and second portion 1208/1258 into the respective first and second securing means 845/850. Following the attachments of the first and second portion 1208/1258 into the respective first and second securing means 845/850, a user may stretch the restrained first hoop handle 810 away from the middle portion of the elongate member 855 such that the first hoop handle 810 may abut the first extremity of the first end of the elongate member 1100. As illustrated in FIG. 17, the first latch means 1206 may be adapted to cover the first cavity opening 875 of the first securing means 845. It may be an advantage to have the first latch means 1206 covering the first cavity opening 875 of the first securing means 845 to provide a predetermined restraining force to the first position 1208 such that the first portion 1208 may not easily slip out of the first securing means 845.

Similarly, a user may stretch the restrained second hoop handle 815 away from the middle portion of the elongate member 855 such that the second hoop handle 815 may abut the second extremity of the second end of the elongate member 1150. As illustrated in FIG. 17, the second latch means 1256 may be adapted to cover the second cavity opening 876 of the second securing means 850. It may be an advantage to have the second latch means 1256 covering the second cavity opening 870 of the second securing means 850 to provide a predetermined restraining force to the second portion 1258 such that the second portion 1258 may not easily slip out of the second securing means 850. In this latched configuration, the user may lift the flexible tub 100 with the device 800.

The first and second restraining straps 1202/1252 may each be flexible and resiliently biased to support a predetermined weight when the flexible tub 100 with or without contents may be carried with the device 800. It may be advantageous to provide the first/second restraining strap 1202/1252 with the first/second latch means 1206/1256 covering the first/second cavity opening 875/876 of the first/second securing means 845/850 prior to lifting, such that the weight may move the first/second latch means 1206/1256 down from a position relatively level to the first/second cavity opening 875/876 to a position abutting flush against the first/second cavity wall 885/886 of the first/second securing means 845/850. When carried, the first/second cavity wall 885/886 may provide a predetermined weight of the flexible tub 100 with or without contents. When the first/second latch means 1206/1256 may be at a position abutting flush against the first/second cavity wall 885/886 of the first/second securing means 845/850, the first/second latch means 1206/1256 may provide a predetermined restraining force to the first/second portion 1208/1258 from slipping out of the respective first/second securing means 845/850. The first/second latch means 1206/1256 may provide a relatively higher predetermined restraining force to the first/second portion 1208/1258 when the device 800 lifts a relatively heavier flexible tub 100.

As illustrated in FIG. 16, when the flexible tub 100 is in engagement relatively level on the floor, the first and second latch means 1206/1256 may be unlatched by applying a predetermined downward force from the middle portion of the elongate member 855. The first and second latch means 1206/1256 may also be unlatched when the user uses a hand to grip the handle 860 and uses the other hand to exert a turning moment on the first or second latch means 1206/1256 to slide over the respective first and second extremities 1100/1150. The user's thumb may depress on the first or second latch means 1206/1256 while the user's other fingers may depress on the lower surface of the elongate member 830 to allow the user's thumb to exert a turning moment and a predetermined pushing force away from the middle portion of the elongate member 855 such that the first or second latch means 1206/1256 slides over the respective first or second extremity 1100/1150 of the first or second end of the elongate member. While the first or second latch means 1206/1256 may be in the unlatched configuration, the first and second portion 1208/1258 may still be secured in the respective first and second securing means 845/850.

Figure 18:
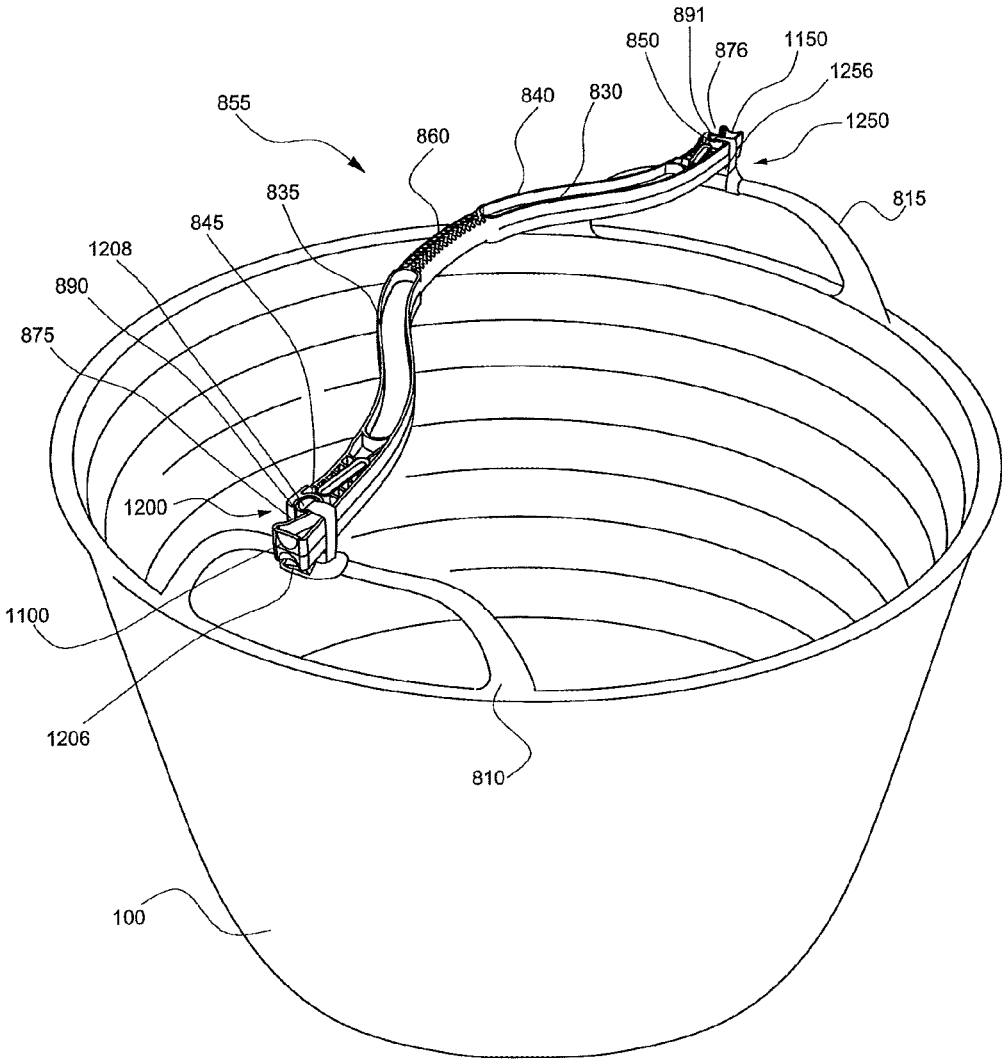
FIG. 18 depicts another perspective view of the restraining means attached to the preferred embodiment of FIG. 8.

In the unlatched configuration, as illustrated in FIGS. 16 and 18, the restrained first loop handle 810 may no longer abut the first extremity of the first end of the elongate member 1100, and the restrained second hoop handle 815 may also no longer abut the second extremity of the second end of the elongate member 1150. In this unlatched configuration, as illustrated in FIG. 18, the user may apply a predetermined force perpendicular to the longitudinal axis of the elongate member to move the elongate member from a vertical configuration to a horizontal configuration relative to the plane of the flexible tub opening. It may be an advantage to provide the restraining means to allow the device 800 to move into the horizontal configuration as it may be space efficient for storage and allow for easier storage of the flexible tub with the device 800. It may be another advantage to provide the restraining means to allow the device 800 to move into the horizontal configuration to allow the user a relatively clearer access into the open tub compared to the device 800 in the vertical configuration. It may be appreciated that the reverse process may be applied in the reverse to allow for the user to rotate the elongate member back to the vertical configuration from a horizontal configuration when it may be time for the user to carry the flexible tub with the device 800.

Although the invention has been described with reference to specific examples, it will be appreciated by those skilled in the art that the invention may be embodied in many other forms, in keeping with the broad principles and the spirit of the invention described herein.

The present invention and the described preferred embodiments specifically include at least one feature that is industrial applicable.

What is claimed is:

1. A device for carrying a flexible tub having a first hoop handle and a second hoop handle, the device comprising:

an elongate member comprising an upper surface, a lower surface, a first end, and a second end opposite the first end;

wherein the first end comprises a first handle connector, and wherein the second end comprises a second handle connector;

a flexible and circular first restraining strap to engage and restrain the first hoop handle with the first handle connector, wherein the first restraining strap comprises a resiliently biased first material and a first cover portion, wherein the first material and the first cover portion are adapted to engage with the first handle connector;

wherein the first handle connector is adapted to receive the first hoop handle, when in use, and the second handle connector is adapted to receive the second hoop handle, when in use.

2. The device according to claim 1, wherein the first handle connector is positioned on the upper surface, and wherein the second handle connector is positioned on the upper surface.

3. The device according to claim 1, wherein the elongate member is adapted to bend and be resiliently biased to absorb load of the flexible tub.

4. The device according to claim 1, wherein the first handle connector is a first cavity, and wherein the second handle connector is a second cavity.

5. The device according to claim 4, wherein the first or second cavity has an elliptical profile wherein an apex is directed towards a middle of the elongate member.

6. The device according to claim 4, wherein the first handle connector has a first boss positioned at a cavity opening of the first cavity, and wherein the second handle connector has a second boss positioned at a cavity opening of the second cavity.

7. The device according to claim 6, wherein the first boss is a first rounded face, and wherein the second boss is a second rounded face.

8. The device according to claim 4, wherein the first cavity is directed away from the second cavity.

9. The device according to claim 1, wherein the first end comprises a first strap attachment, and the second end comprises a second strap attachment.

10. The device according to claim 9, wherein the first strap attachment and the second strap attachment are each selected from at least one of a support loop mounted on the upper surface and a slot positioned between the upper surface and the lower surface.

11. The device according to claim 1, wherein a middle of the elongate member includes a handle adapted to be gripped by a user, when in use.

12. The device according to claim 1, wherein a profile of the first end is symmetrical relative to a profile of the second end.

13. The device according to claim 1, wherein a length of the elongate member is greater than a resting diameter of the flexible tub; and the length of the elongate member is less than a maximum diameter of the flexible tub, wherein the first and second hoop handles are moved apart.

14. The device according to claim 1, wherein the device is adapted to engage a maximum of only one flexible tub at any period of time.

15. The device according to claim 1, wherein the device is constructed of one material selected from the following group: polypropylene, glass fiber reinforced polypropylene, poly(hexano-6-lactam), glass fiber reinforced poly(hexano-6-lactam), acrylonitrile butadiene styrene, blend of polycarbonate and acrylonitrile butadiene styrene, glass fiber reinforced polycarbonate and acrylonitrile butadiene styrene, and high-density polyethylene.

16. The device according to claim 15, wherein the glass fiber is present in a range between 20 to 50 weight percentage in the glass fiber reinforced polypropylene, or the glass fiber reinforced poly(hexano-6-lactam), or the glass fiber reinforced blend of polycarbonate and acrylonitrile butadiene styrene.

17. The device according to claim 1, wherein the device is formed by injection moulding.

18. The device according to claim 1, wherein the elongate member has a curved profile.

19. The device according to claim 18, wherein the elongate member has a partially sinusoidal profile.

20. The device according to claim 1, further comprising a flexible and circular second restraining strap to engage and restrain the second hoop handle with the second handle connector, wherein the second restraining strap comprises a resiliently biased second material and a second cover portion, wherein the second material and the second portion are adapted to engage with the second handle connector.

* * * * *